United States Patent [19]

Fujiwhara et al.

[11] 4,010,035

[45] Mar. 1, 1977

[54] LIGHT-SENSITIVE SILVER HALIDE COLOR PHOTOGRAPHIC MATERIAL AND A PROCESS FOR DEVELOPING THEREOF

[75] Inventors: Mitsuto Fujiwhara; Takaya Endo; Ryosuke Satoh, all of Hino, Japan

[73] Assignee: Konishiroku Photo Industry Co., Ltd., Tokyo, Japan

[22] Filed: May 15, 1975

[21] Appl. No.: 577,931

[30] Foreign Application Priority Data

May 29, 1974 Japan ..... 49-60411

[52] U.S. Cl. ..... 96/66.3; 96/22; 96/74; 96/95; 96/100; 96/111

[51] Int. Cl.[2] ..... G03C 5/30; G03C 1/06

[58] Field of Search ..... 96/100, 111, 95, 66.3

[56] References Cited

UNITED STATES PATENTS

| | | | |
|---|---|---|---|
| 3,227,554 | 1/1966 | Barr et al. | 96/95 |
| 3,364,022 | 1/1968 | Barr | 96/95 |
| 3,379,529 | 4/1968 | Porter et al. | 96/95 |
| 3,615,506 | 10/1971 | Abbott et al. | 96/100 |
| 3,632,345 | 1/1972 | Marx et al. | 96/95 |
| 3,756,821 | 9/1973 | Hayashi et al. | 96/95 |
| 3,869,291 | 4/1975 | Mader et al. | 96/100 |
| 3,881,933 | 5/1975 | Kumai et al. | 96/111 |
| 3,923,517 | 12/1975 | Yamamoto et al. | 96/95 |
| 3,926,634 | 12/1975 | Sugizaki et al. | 96/56.5 |
| 3,958,993 | 5/1976 | Fujiwhara et al. | 96/95 |

*Primary Examiner*—J. Travis Brown
*Attorney, Agent, or Firm*—Flynn & Frishauf

[57] ABSTRACT

A light-sensitive silver halide color photographic material comprising a new development inhibitor releasing type compound and a hardening agent and a process for developing thereof.

10 Claims, No Drawings

LIGHT-SENSITIVE SILVER HALIDE COLOR PHOTOGRAPHIC MATERIAL AND A PROCESS FOR DEVELOPING THEREOF

This invention relates to a light-sensitive silver halide colour photographic material and a process for developing the said material. Especially, this invention relates to a light-sensitive silver halide colour photographic material and a process for developing thereof which comprises a compound having the following formula and a photographic hardening agent:

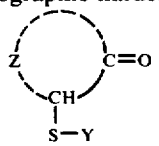

wherein Z represents an atomic group necessary to complete an alicyclic ring or heterocyclic ring, both of which may be substitited, saturated or unsaturated, and Y represents a radical capable of forming a compound having development inhibiting action together with a sulfur atom when the bond of the thioether is splitted.

Generally speaking, a light-sensitive silver halide colour photographic material consists of multiple layers of more than three layers of blue, green and red light sensitive layers. Besides these principal three layers, several kinds of supplemental layers such as intermediate layer, protecting one, yellow filter one and the like can be used. Also a light-sensitive colour photographic material consisting of several layers in which the above principal three layers are composed of respective multiple layers is sold now.

These light-sensitive colour photographic materials are usually, after exposure, colour-developed by a colour developer containing ethylenediamine type colour developing agent, and then subjected to the treatments such as desileverization and fixation to give colour image. These treatments such as development, desilverization and fixation are effected in a large scale at a place such as colour laboratory, but it is necessary to make these treatments speedy in order to elevate their operation rate.

As to main procedures to speed colour treatments, there are at least two procedures: one of shortening the treatment time by raising treating temperature and the other one of decreasing steps necessary for the treatments. But at present by combining these two procedures, speed-up and non-pollution are planned. As the treatment is effected at a higher temperature, as light-sensitive colour photographic material, an emulsion film having extremely higher hardening film with physical characters such as are resistant against high-temperature treatment is needed. The binder composed of emulsion layer of light-sensitive colour photographic material is mainly gelatine and there is a need for, extremely, an excellent hardening agent. As representative hardening agent, there are many ones such as aldehyde type, aziridine type, isoxazole type, epoxy type and vinylsulphone type. But these hardening agents are so extremely active compounds that they often worsen extremely photographic characters by reacting with other additives in gelatine as well as they harden gelatine. Especially, in the case of Ekta type colour photographic material, a large amount of coupler are so present in gelatine emulsion that the coupler reacts well with the hardening agent to decrease photographic characters. This is considered up to now a defect. Therefore, to avoid this defect, several tests such as a method of using a treating bath containing, for example, aldehyde type hardening agent, namely prehardening bath, which is decreasing extremely an amount of hardening agent used for light-sensitive colour photographic material and a method of non-using aldehyde type hardening agent which is easily reactive to coupler are tried.

On the other hand, as to a method of elevating colour purity and improving granularity of light-sensitive colour photographic material, there are proposed methods of using development inhibitor releasing type couplers (hereinafter referred to as DIR coupler) such as are described in U.S. Pat. (hereinafter referred to as U.S.) No. 314,806 or of using compounds which release development inhibitors but form dyes (hereinafter referred to as DIR material). These DIR coupler and DIR material (hereinafter both are together referred to as DIR compound) are fairly unstable compounds because of having radicals which form development inhibitor in the active center reacting with oxidation products of developer. Particularly, in the case of using these compounds together with the above hardening agents, known DIR compounds are very reactive that they release at once inhibitors and result in extreme desensitization. Therefore, it is very difficult for light-sensitive colour photographic materials to be hardened and now there is a great obstacle against speedy treatment.

The present inventors found that after an extensive study in consideration of the above situations, incorporation of DIR compounds having the following formula and photographic hardening agents together in Ekta type light-sensitive silver halide colour photographic materials makes colour purity and granularity better and so gives light-sensitive silver halide colour photographic materials having better hardening standing with higher temperature treatment:

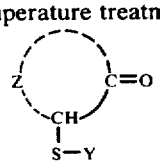

wherein Z represents an atomic group necessary to complete an alicyclic ring or heterocyclic ring, each of which may be substituted, saturated or unsaturated and Y represents a radical capable of forming a compound having development inhibiting action together with a sulfur atom when the bond of the thioether is split.

The DIR compounds having the above formula according to this invention are those which react with an oxidation product of developer and release a development inhibitor, and at the same time those substantially forming no dye and so what are called DIR materials. These compounds are extremely stable in comparison with known DIR compounds and do not react with photographic hardening agents when used in combination with them, so that they have excellent advantages in that they do not deteriorate photographic characters.

As representative compounds having the above formula, Z represents an atomic group necessary to complete an alicyclic ring or heterocyclic ring containing oxygen, nitrogen or sulfur atom in 5, 6, or 7 membered ring, each of which ring may be saturated or unsaturated, such as those selected from group consisting of cyclopentanone, cyclohexanone, cyclohexenone, piperidone (for example, 2-, 3-, and 4-piperidone), lactone (for example, 4 - 7 membered ring), lactam (pyrrolidone) and hydantoin or thiohydantoin and these alicyclic ring or heterocyclic rings may be substituted with one or more of substituents such as alkyl, aryl, alkoxy, aryloxy, acyl, alkoxycarbonyl, halogen, nitrile, nitro, sulfamido or acylamino or —S—Y radical and may form condensed rings in a suitable place such as indanone, benzcyclohexenone, benzcycloheptenone, oxyindole. Also, these alicyclic rings or heterocyclic rings may have more than one of —S—Y (Y means the same meaning as above) adjacent to the carbonyl group. On the other hand, Y in the formula means a radical capable of forming a compound having development inhibiting action of such compounds as an aryl mercapto-compound, heterocyclic mercapto-compound, thioglycolic acid type compound, cysteine or glutathion together with a sulfur atom when the bond of thioether is split. As representative mercapto-compounds of Y, there can be mentioned heterocyclic mercapto-compounds such as mercaptotetrazole type compounds, especially 1-phenyl-2-mercaptotetrazole, 1-nitrophenyl-5-mercaptotetrazole, 1-naphthyl-5-mercaptotetrazole, mercaptothiazole type compounds especially 2-mercaptobenzthiazole, mercaptonaphthothiazole, mercapto-oxadiazole type compounds, mercaptopiperidine type compounds, mercaptothiadiazole type compounds, especially 2-mercaptothiadiazolotriazine, mercaptotriazine type compounds, mercaptotriazole type compounds, or mercaptobenzene type compounds, especially 1-mercapto-2-benzoic acid, 1-mercapto-2-nitrobenzene, and 1-mercapto-3-heptadecanoylaminobenzene.

The respresentative examples of these compounds having the above formula are as follows.

D-1

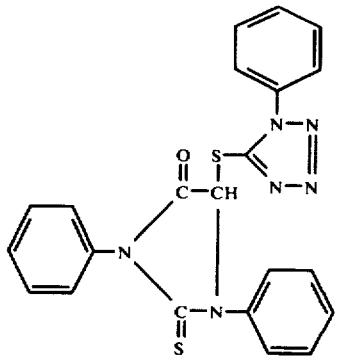

D-2

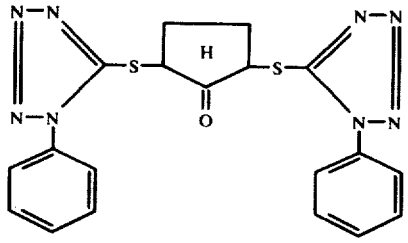

D-3

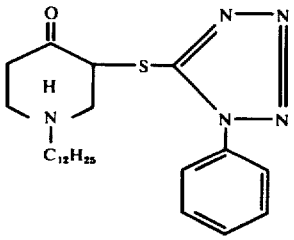

-continued
D-4
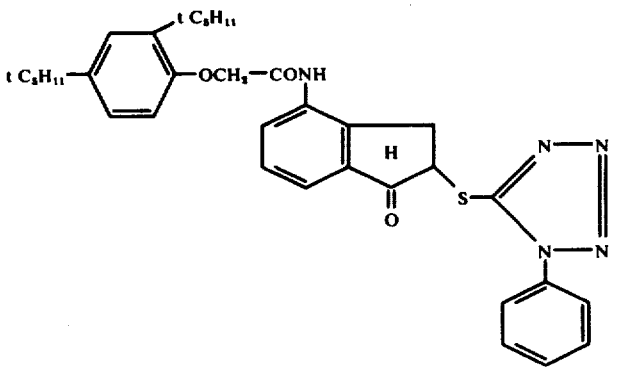
D-5
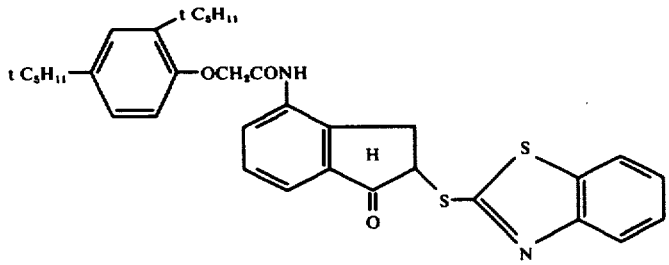
D-6
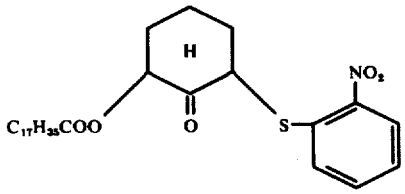
D-7
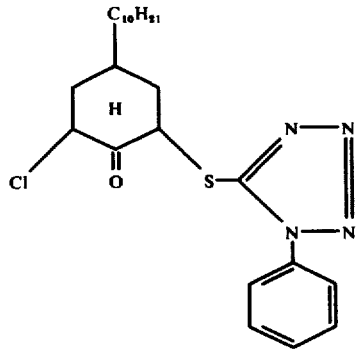
D-8
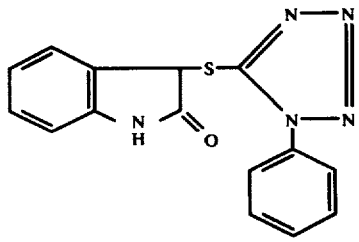

-continued
D-9
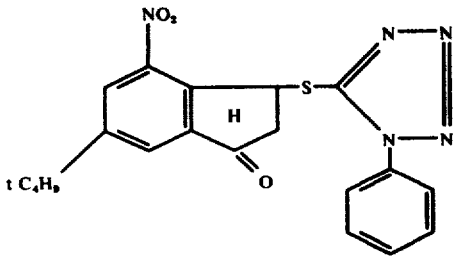
D-10
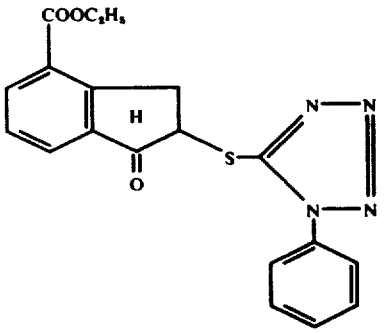
D-11
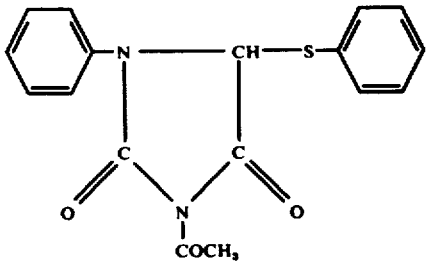
D-12
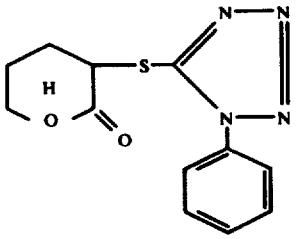
D-13
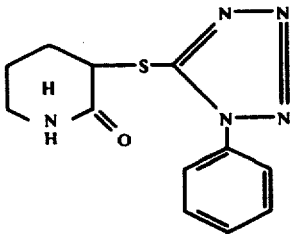
D-14
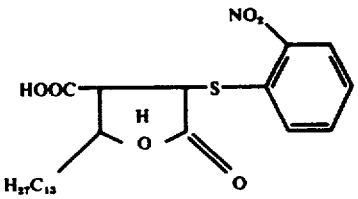

-continued
D-15
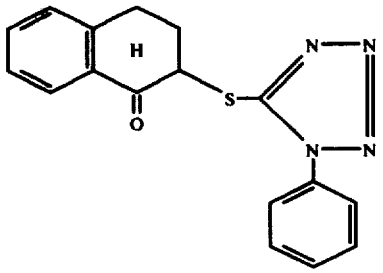
D-16
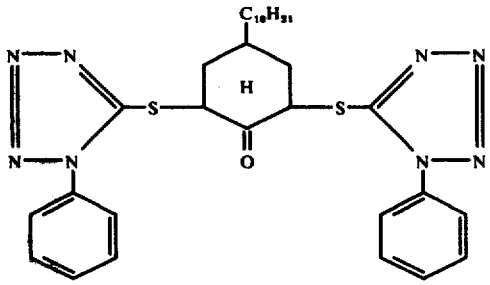
D-17
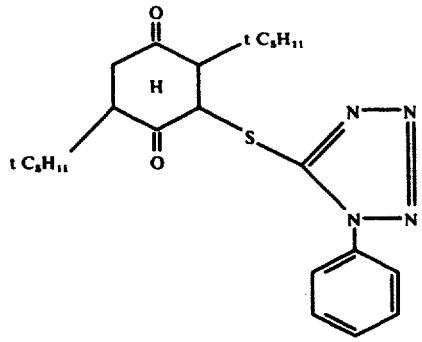
D-18
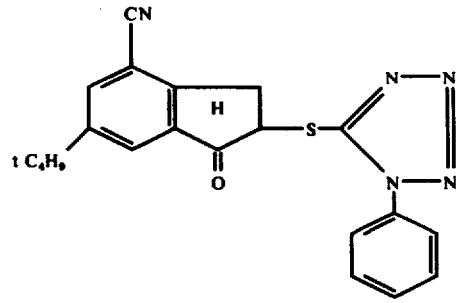
D-19
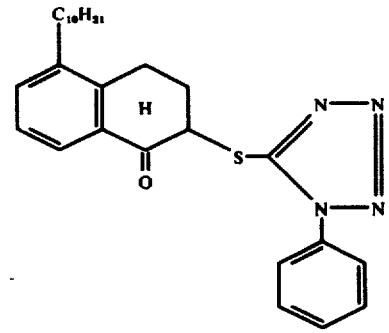

-continued
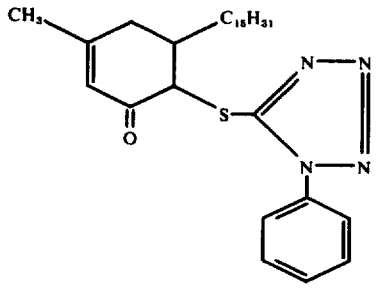
D-20
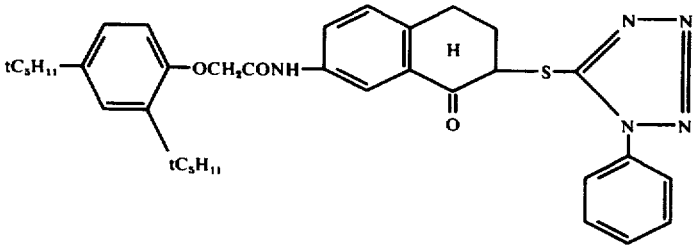
D-21
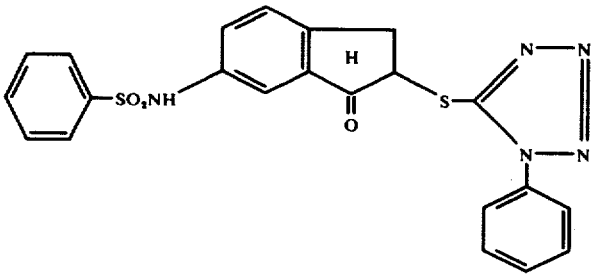
D-22
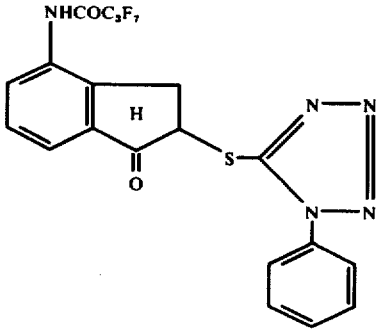
D-23
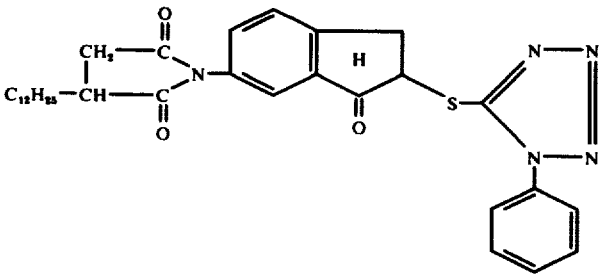
D-24

-continued
D-25
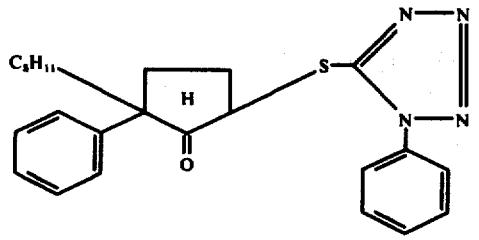
D-26
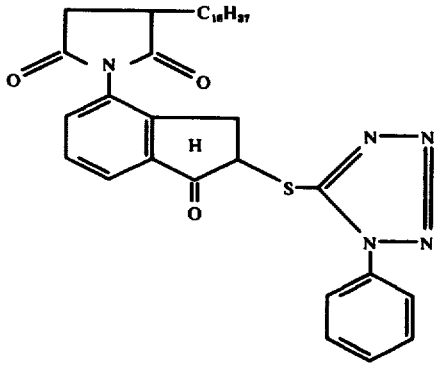
D-27
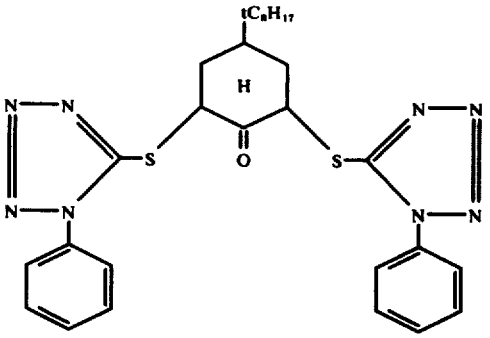
D-28
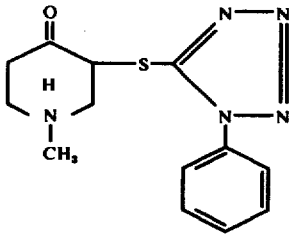
D-29
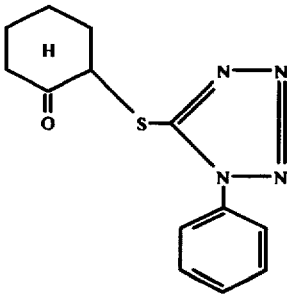
As hardening agents used in combination with DIR materials having the above formula according to this invention, there can be mentioned usual photographic hardening agents such as aldehyde type, aziridine type (these are described in PB Report 19921, U.S. Pat. Nos. 2,950,197; 2,964,404; 2,983,611, 3,271,175, Patent Publication (hereinafter referred to as P.P.) No. 46-40898), isoxazole type (for example, described in U.S. Pat. No. 3,316,095), epoxy type (for example, described in U.S. Pat. No. 3,047,394, DP No. 1,085,663, BP No. 1,033,518, P.P. No. 48-35495), vinylsulphone type (for example, described in PB Report No. 19920, DP No. 1,100,942, BP No. 1,251,091, Patent Application (hereinafter referred to as P.A.) No.. 45-54236, P.A. No. 48-110990, P.A. No. 48-115745, U.S. Pat. Nos. 3,539,644, 3,490,911), acryloyl type (for example, described in P.P. No. 48-27949, U.S. Pat. No. 3,640,720), carbodi-imide type (for example, described in U.S. Pat. No. 2,938,892, P.P. No. 46-38715, P.A. No. 49-15095), maleimide type (for example, described in U.S. Pat. Nos. 2,992,109, 3,232,763), acetylene type (for example, described in DP No. 2,130,483), methanesulfonate type (for example, described in U.S. Pat. Nos. 2,726,162; 2,816,125), mucohalogenic acid (for example, described in U.S. Pat. No. 3,110,597, P.A. No. 48-30948), high molecular compound type (for example, U.S. Pat. No. 3,058,827, BP No. 822,061, BP No. 1,049,083, BP No. 1,202,052, BP No. 1,230,354), triazine type (for example, described in U.S. Pat. No. 3,288,775, P.P. No. 48-108497). But as hardening agents having more preferable effect in combination with the DIR material having the above formula according to this invention, there can be mentioned those described in U.S. Pat. No. 2,726,162, P.A. No. 48-30948, PB Report No. 19921, P.P. No. 46-40898, P.A. No. 48-108497, P.A. No. 45-54236, P.A. No. 45-10996, P.A. No. 45-110996, P.A. No. 48-115745, PB Report No. 19920, P.A. No. 48-27949, P.A. No. 49-15096, BP No. 1251091 and remarkable effects of this invention can be obtained in combination with these hardening agents.

Next, representative hardening agents can be mentioned as follows but are not meant to limit these specific agents only:

HCHO H-1

OHC . CHO H-3

OHC . $CH_2CH_2$ . CHO H-3

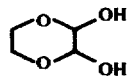

H-4

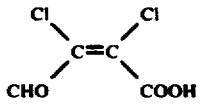

H-5

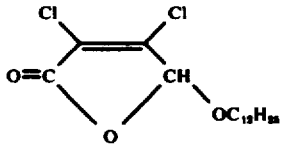

H-6

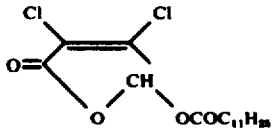

H-7

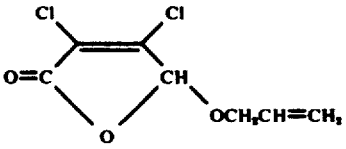

H-8

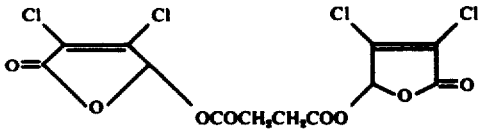

H-9

$CH_3SO_2CH_2CH_2OSO_2CH_3$ H-10

$CH_3SO_2CH_2CH_2CH_2OSO_2CH_3$ H-11

$CH_3SO_2CH_2CH_2OCH_2CH_2OSO_2CH_3$ H-12

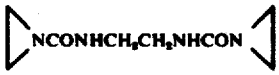

H-13

-continued
H-14
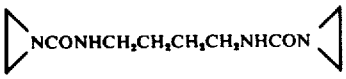
H-15
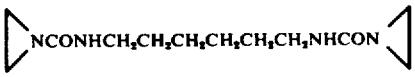
H-16
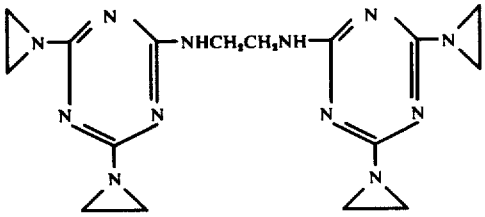
H-17
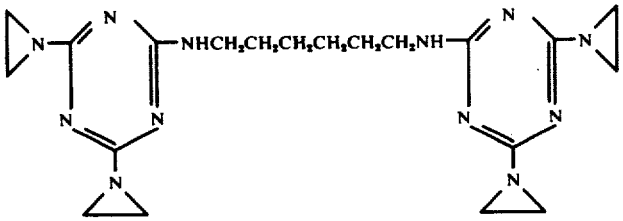
H-18
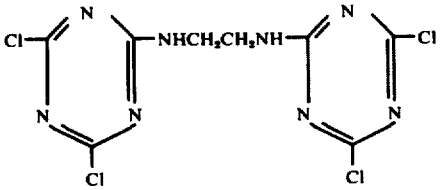
H-19
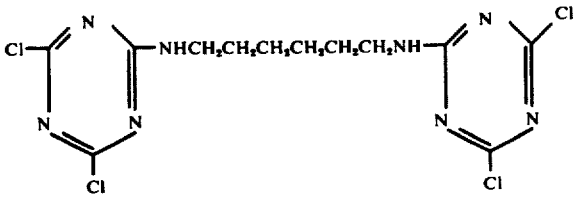
H-20
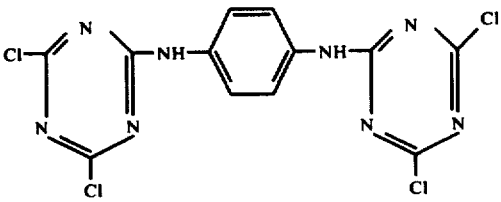
H-21
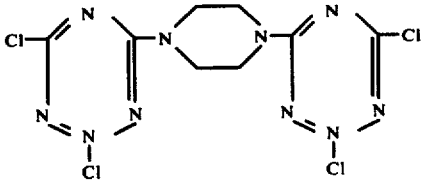
$CH_2{=}CHSO_2CH{=}CH_2$ H-22
$CH_2{=}CHSO_2CH_2SO_2CH{=}CH_2$ H-23
$CH_2{=}CHSO_2CH_2CH_2SO_2CH{=}CH_2$ H-24
$CH_2{=}CHSO_2CH_2CH_2CH_2SO_2CH{=}CH_2$ H-25

-continued
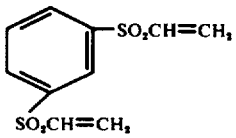
H-26
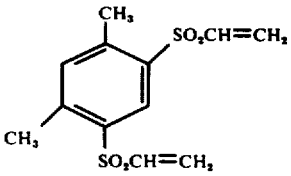
H-27
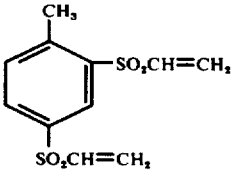
H-28
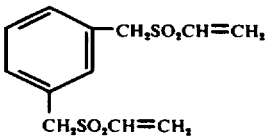
H-29
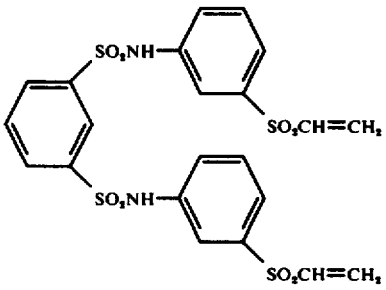
H-30
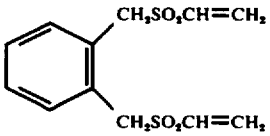
H-31
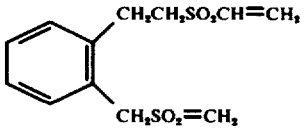
H-32
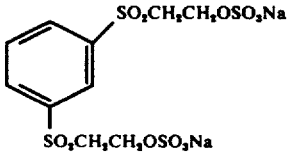
H-33
$H_4NOSO_3CH_2CH_2SO_2CH_2CH_2SO_2CH_2CH_2OSO_3NH_4$ H-34

-continued

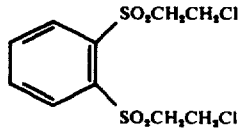

H-35

$CH_2{=}CHSO_2CH_2OCH_2SO_2CH{=}CH_2$ H-36

$CH_2{=}CHSO_2CH_2CH_2{-}O{-}CH_2{-}CH_2SO_2CH{=}CH_2$ H-37

$CH_2{=}CHSO_2CH_2{-}CH_2CH_2OCH_2SO_2CH{=}CH_2$ H-38

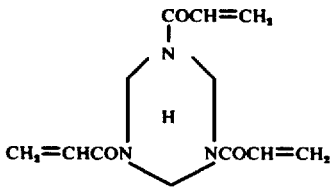

H-39

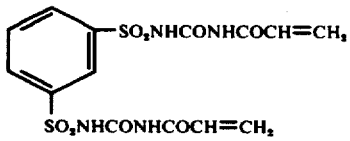

H-40

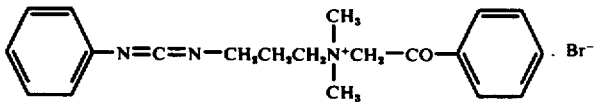

H-41

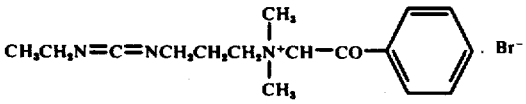

H-42

$CH_2{=}CHCOOCH_2CH_2N{=}C{=}N{-}C_2H_5$ H-43

Also, application of these hardening agents to the light-sensitive silver halide colour photographic materials can be conveniently carried out by adding and mixing them in advance in the coating liquid or by using a continuous mixing method in advance in the coating liquid by means of an apparatus such as is described in U.S. Pat. No. 3,286,992.

In the light-sensitive silver halide colour photographic materials, a coupler is caused to be contained to a colour image. As useful couplers, there can be mentioned open-chain a methylene type yellow coupler, pyrazolone type magenta coupler, phenol type or naphthol type cyan coupler and in combination with these couplers, a azo type coloured coupler, osazone type compound, development deffusive dye releasing type coupler can be used for auto-masking. As yellow couplers, there are used up to now open-chain ketomethylene compounds. For example, as pivalyl acetoanilide type yellow coupler, those described in FP No. 1,291,110 can be used as an effective yellow coupler, as a benzoylacetanilide type yellow coupler, those described in P.P. No. 46-19031, U.S. Pat. No. 2,875,051 can be also used, and further what is called a two equivalent coupler, for example an active center-o-allyl substituted compound described in U.S. Pat. No. 3,408,194, active center-o-acyl substituted compound described in U.S. Pat. No. 3,447,928, active center-o-hydantoin substituted compound described in patent laid-open (hereinafter referred to as P.L.O.) No. 48-29432, active-center urazole substituted compound described in P.L.O. No. 48-66834, active center succinimide substituted compound described in P.A. No. 45-119053, active center monoxoimide substituted compound described in P.A. No. 48-79309, active center pyridazone substituted compound described in P.L.O. No. 49-10736, active center fluoro-substituted compound described in BP No. 944,490, active center chlorine- or bromine-substituted compound described in BP No. 780,507, active center-o-sulfonyl substituted compound described in BP No. 1,092,506 can be used as effective yellow couplers. Among these yellow couplers, those described in U.S. Pat. No. 3,408,194, P.L.O. No. 48-29432, P.A. No. 48-79309, P.L.O. No. 48-66834 are especially effective.

The representative effective yellow couplers according to this invention are as follows:

Y-1
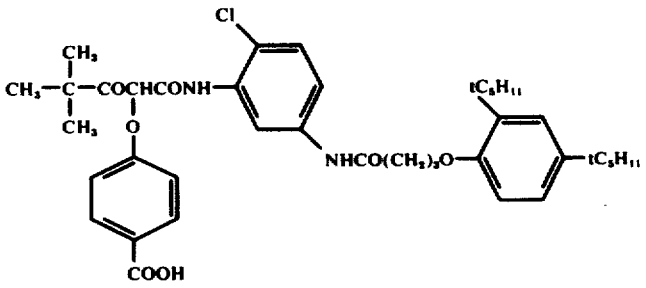
α-(4-carboxyphenoxy)-α-pivalyl-2-chloro-5-[γ-(2,4-di-tert-amylphenoxy)butanamido]acetanilide
α-[4-(4-hydroxyphenylsulfonyl)phenoxy]-α-pivalyl-4-(N-methyl-N-octadecylsulfamyl)acetanilide
Y-3
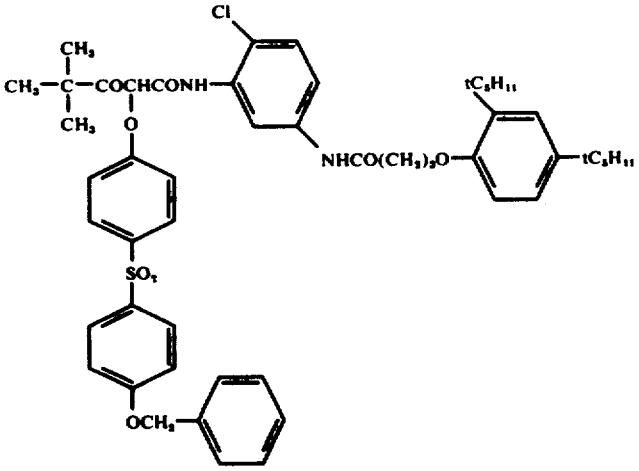
Y-2
α-[4-(4-benzyloxyphenylsulfonyl)phenoxy]-α-pivalyl-2-chloro-5-[γ-(2,4-di-tert-amylphenoxy)-butanamido]acetanilide
Y-4
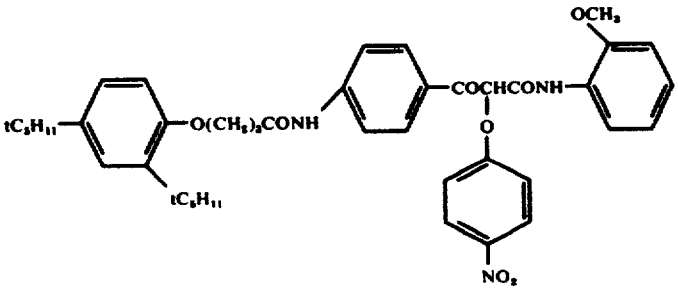
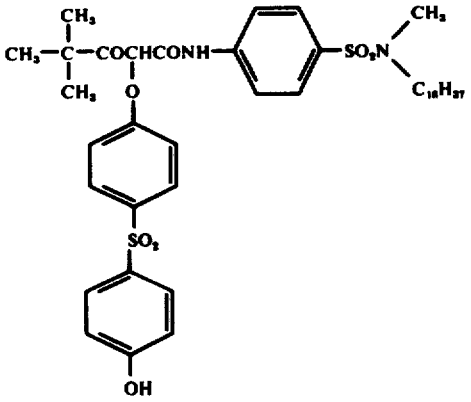
α-{3-[γ-(2,4-di-tert-amylphenoxy)butanamido]-benzoyl}-α-(4-nitrophenoxy)-2-methoxy-acetanilide

Y-5

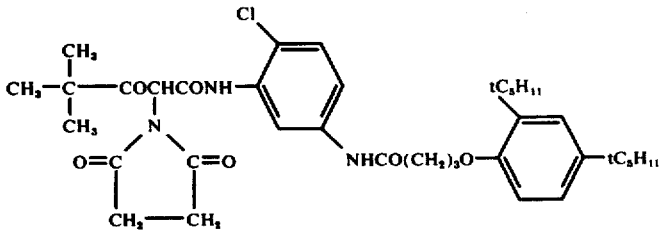

α-succinimido-α-pivalyl-2-chloro-5-[γ-(2,4-di-tert-amylphenoxy)butanamido]acetanilide

Y-6

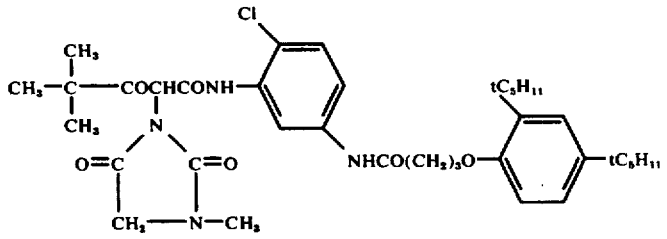

α-(3-methyl-25-dioxo-1-imidazolidinyl)pivalyl-2-chloro-5-[γ-2,4-di-tert-amylphenoxy)-butanamido]acetanilide.

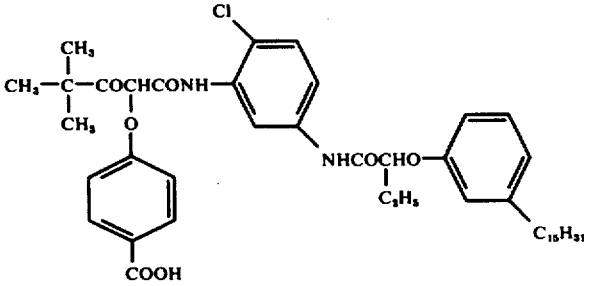

α-(4-carboxyphenoxy)-α-pivalyl-2-chloro-5-[α-(3-n-pentadecylphenoxy)butanamido]acetanilide

Y-7

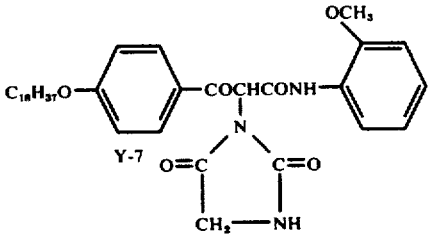

α-(2,5-dioxo-1-imidazolidinyl)-α-(p-octadecyloxy-benzoyl)-2-methoxy-acetanilide

Y-8

Y-9

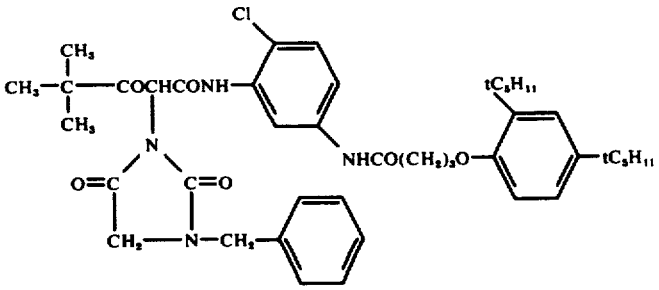

α-(3-benzyl-2,5-dioxo-1-imidazolidinyl)-4-pivalyl-2-chloro-5-[γ-(2,4-di-tert-amylphenoxy)-butanamido]acetanilide Y-10
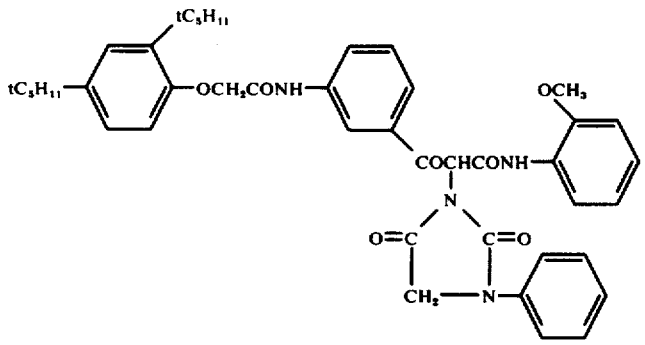
α-(3-phenyl-2,5-dioxo-1-imidazolidinyl)-α-{3-[α-(2,4-di-tert-amylphenoxy)butanamido]benzoyl}-2-methoxyacetanilide
α-pivalyl-α-[1-(3-methyl-4-phenyl-2,5-dioxo-1,3,4-triazolidinyl)]-2-chloro-5-[γ-(2,4-di-tert-amylphenoxy)butanamido]acetanilide
Y-11
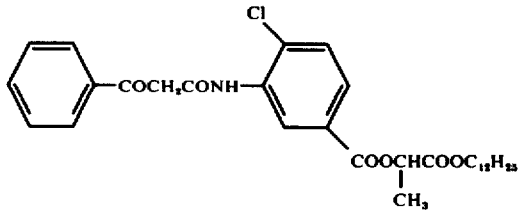
α-benzoyl-2-chloro-5-[α-(dodecyloxycarbonyl)ethoxycarbonyl]-acetanilide
Y-13
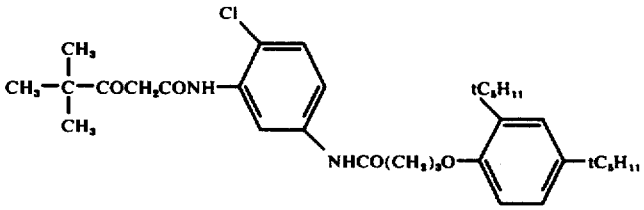
α-pivalyl-2-chloro-5-[γ-(2,4-di-tert-amylphenoxy)-butanamido]acetanilide
Y-12
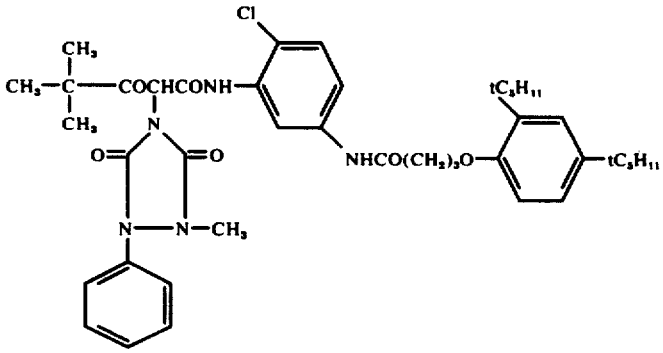

Y-14

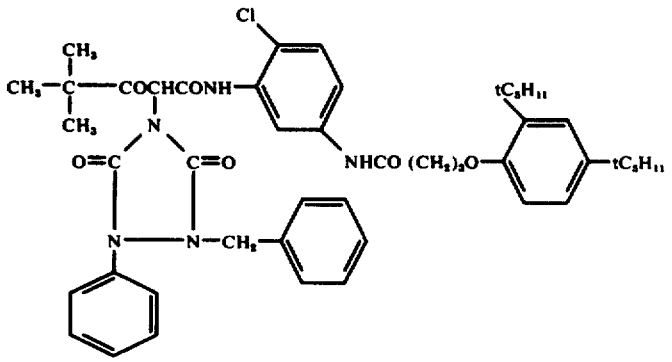

α-pivalyl-α-[1-(3-benzyl-4-phenyl-2,5-dioxo-1,3,4-triazolidinyl)]-2-chloro-5-[γ-(2,4-di-tert-amylphenoxy)butanamido]acetanilide 2′-chloro-2-(3,3-dimethyl-5-oxo-4H,5H-1,2,3-triazol-1-yl)-5′-{α-(3-pentadecylphenoxy)butanamido}-2-pivaloylacetanilide

Y-15

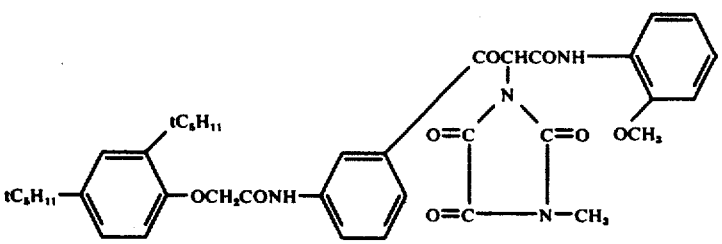

Y-17

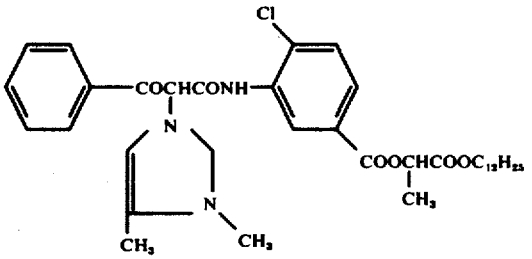

α-[3-{α-(2,4-di-tert-amylphenoxy)butylamido}benzoyl]-α-{1-(3-methyl-2,4,5-trioxo-imidazolidinyl)}2-methoxy-acetanilide 2-benzoyl-2′-chloro-5′-{α-(dodecyloxycarbonyl)ethoxycarbonyl}-2-(1,5-dimethyl-2-oxo-2H,3H-imidazol-3-yl)-acetanilide

Y-16

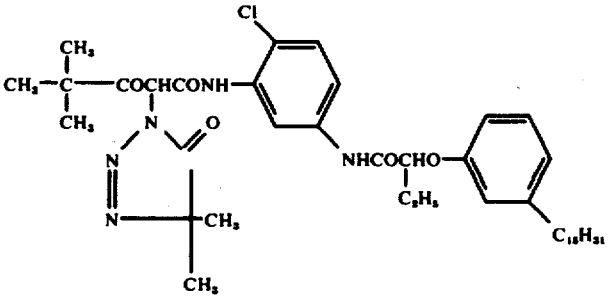

Y-18

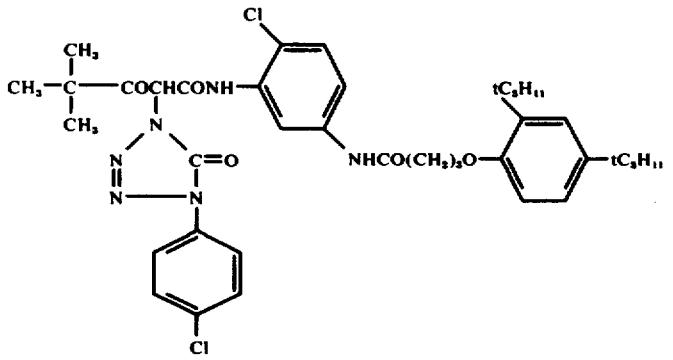

2'-chloro-2-{4-(4-chlorophenyl)-5-oxo-4H,5H-tetrazol-1-yl}-2-pivaloyl-5'-{γ-(2,4-di-tert-amylphenoxy)butanamido}acetanilide As magenta couplers used for this invention, there can be mentioned pyrazolone type, pyrazolotriazole type, pyrazolinobenzimidazole type and indazolone type couplers. As a pyrazolone type magenta coupler, those described in U.S. Pat. Nos. 3,127,269; 2,600,788; 3,519,429; 3,419,391; 3,062,653, BP No. 1,342,553, DP No. 2,162,778, P.L.O. No. 49-29639, and P.A. No. 44-8433; as a pyrazolinobenzimidazole type magenta coupler, those described in U.S. Pat. No. 3,061,432, P.P. No. 46-60479, and DP No. 215,611; as an indazolone type magenta couplers, those in described Belgian Pat. No. 769,116. All of the above compounds can be used. As especially preferred magenta couplers according to this invention, there can be mentioned those described in P.A. No. 44-8333, 3-anilinopyrazolone magenta couplers described in U.S. Pat. No. 3,127,269.

Representative useful magenta couplers according to this invention are as follows:

M-1

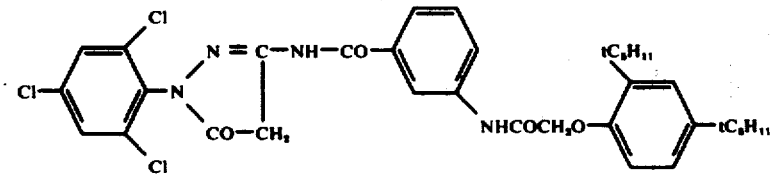

1-(2,4,6-trichlorophenyl)-3-[3-(2,4-di-tert-amylphenoxyacetamido)benzamido]-5-pyrazolone

M-2

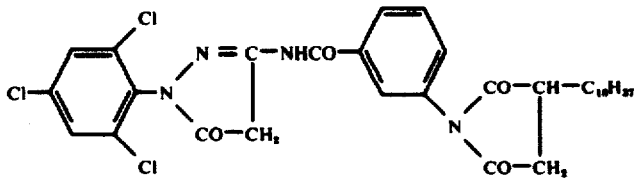

1-(2,4,6-trichlorophenyl)-3-(3-octadecylsuccinimidobenzamido)-5-pyrazolone

M-3

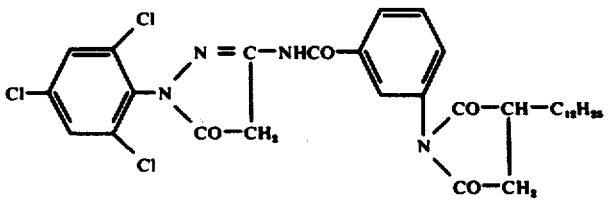

1-(2,4,6-trichlorophenyl)-3-(3-dodecylsuccinimidobenzamido)-5-pyrazolone

M-4

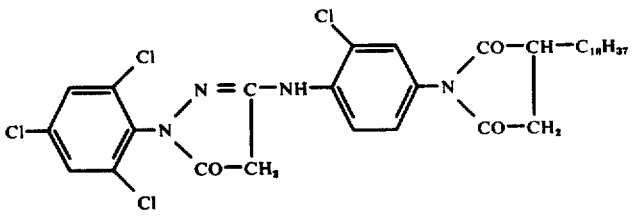

1-(2,4,6-trichlorophenyl)-3-(2-chloro-4-octadecylsuccinimidoanilino)-5-pyrazolone 1-(2,4,6-trichlorophenyl)-3-stearoylamido-5-pyrazolone

M-6

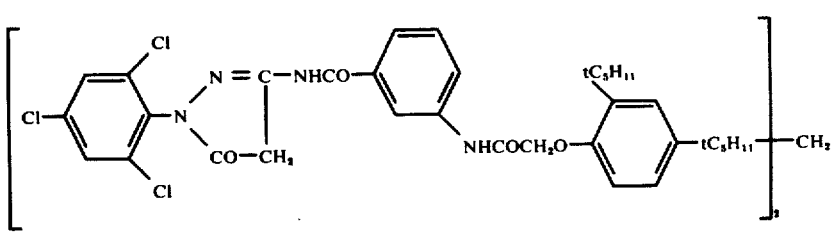

Methylene bis[1-(2,4,6-trichlorophenyl)-3-{3-(2,4-di-tert-amylphenoxyacetamido)benzamido}-5-pyrazolone]

M-5

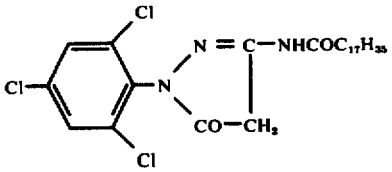

M-7

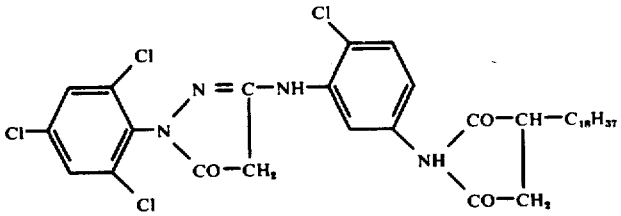

1-(2,4,6-trichlorophenyl)-3-(2-chloro-5-octadecylsuccinimidoanilino)-5-pyrazolone

M-8

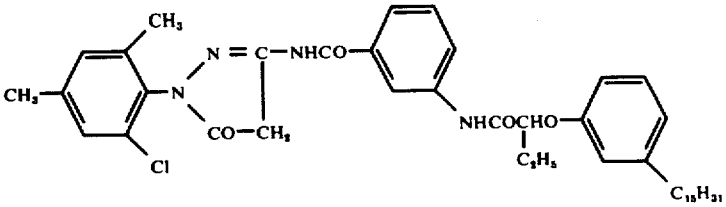

1-(2-chloro-3,5-dimethylphenyl)-3-{3-[α-(3-pentadecylphenoxy)butanamido]benzamido}-5-pyrazolone

M-9

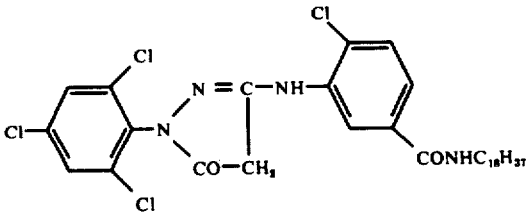

1-(2,4,6-trichlorophenyl)-3-(2-chloro-5-octadecylcarbamoylanilino)-5-pyrazolone

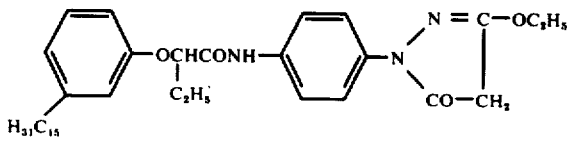

M-10

3-ethoxy-1-{4-[α-(3-pentadecylphenoxy)-butanamido]phenyl}-5-pyrazolone

C-1

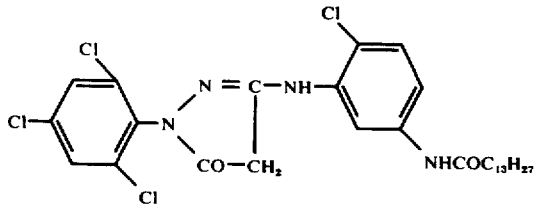

M-11

1-(2,4,6-trichlorophenyl)-3-(2-chloro-5-tetradecanoylamidoanilino)-5-pyrazolone

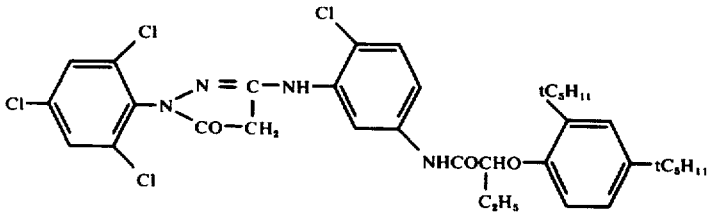

M-12

1-(2,4,6-trichlorophenyl)-3-{2-chloro-5-[α-(2,4-di-tert-amylphenoxy)butanamido]anilino}-5-pyrazolone

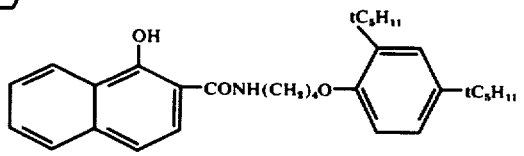

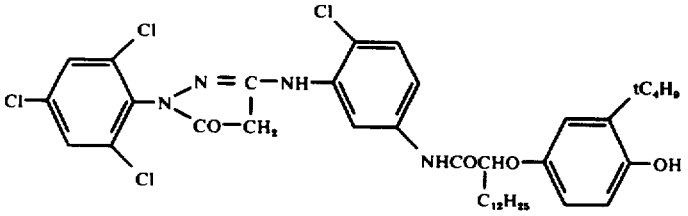

M-13

1-(2,4,6-trichlorophenyl)-3-{2-chloro-5-[2-(4-hydroxy-3-tert-butylphenoxy)tetradecanoylamido]anilino}-5-pyrazolone As famous cyan couplers used for this invention there can be mentioned, for example, phenol type compound described in U.S. Pat. Nos. 2,423,730; 2,801,171; 2,895,826, Belgian Pat. No. 779,512, active center-O-aryl substituted naphthol compound described in U.S. Pat. No. 2,474,293, BP No. 1,084,480, and phenol-naphthol compounds described P.L.O. No. 48-69866, P.A. No. 49-10787, P.A. No. 49-25388, P.A. No. 49-16057, P.A. No. 49-37160.

The useful representative cyan couplers used for this invention are as follows:

2- 4-(2,4-di-tert-amylphenoxy)butyl carbamoyl-1-naphthol

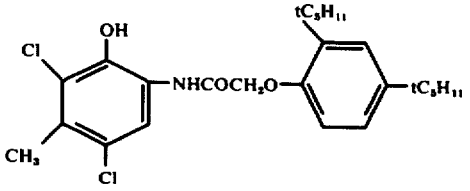

C-2

2,4-dichloro-3-methyl-6-{2-(2,4-di-tert-amylphenoxy)-acetamido} phenol

C-3

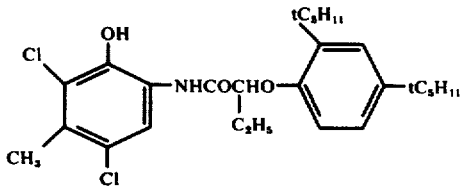

2,4-dichloro-3-methyl-6-{α-(2,4-di-tert-amylphenoxy)butanamido}phenol

C-4

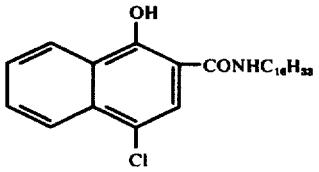

4-chloro-2-hexadecylcarbamoyl-1-naphthol

C-5

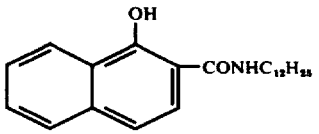

2-dodecylcarbamoyl-1-naphthol

C-6

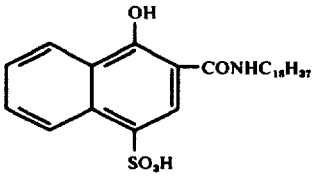

2-octadecylcarbamoyl-4-sulfo-1-naphthol

C-7

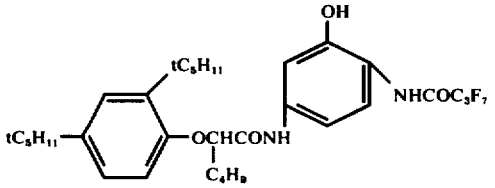

2-perfluorobutyrylamido-5-{2-(2,4-di-tert-amylphenoxy)hexanoylamido}phenol

C-8

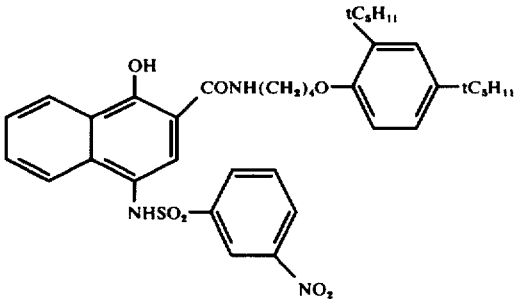

1-hydroxy-4-(3-nitrophenylsulfonamido)-N-{δ-(2,4-di-tert-amylphenoxy)butyl}-2-naphthoamide

C-9

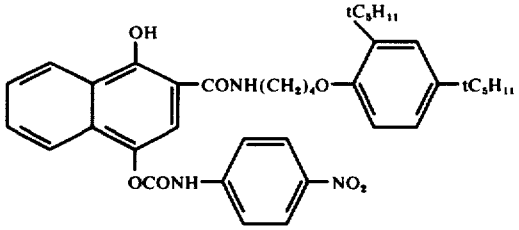

1-hydroxy-4-(4-nitroanilinocarbonyloxy)-N-{δ-(2,4-di-tert-amylphenoxy)butyl}-2-naphthoamide

C-10

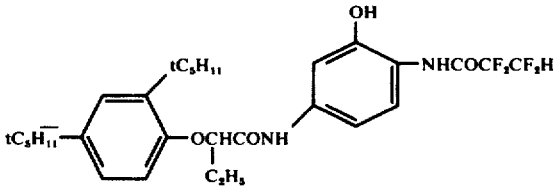

5-{α-(2,4-di-tert-amylphenoxy)butanamido}-2-(2,2,3,3-tetrafluoropropanoylamido)-phenol As coloured magenta couplers, those which are substituted with arylazo- or heteroazo-substituted compounds at the active center of colourless magenta couplers are used. For example such compounds are described in U.S. Pat. Nos. 3,005,712; 2,983,608; 2,801,171; BP No. 93,762 and P.A. No. 44-8433.

The representative compounds are as follows:

CM-1

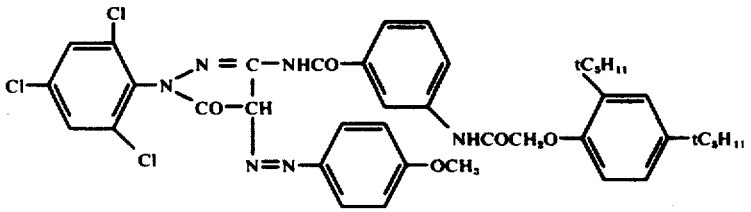

1-(2,4,6-trichlorophenyl)-4-(4-methoxyphenylazo)-3-{2-(2,4-di-tert-amylphenoxy)acetamido}benzamido-5-pyrazolone 1-(2,4,6-trichlorophenyl)-4-(4-hydroxy-3-methylphenylazo)-3-(2-chloro-5-tetradecanoylamidoanilino)-5-pyrazolone

CM-2

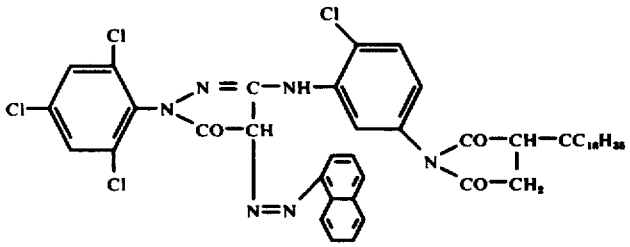

CM-4

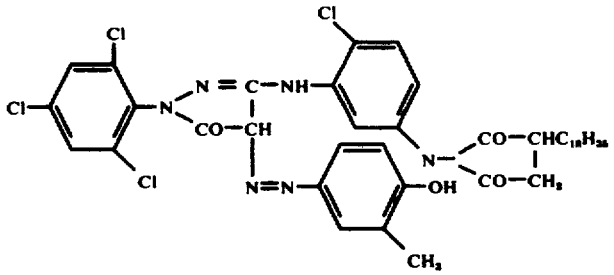

3-(2-chloro-5-octadecenylsuccinimido-anilino)-1-(2,4,6-trichlorophenyl)-4-(1-naphthylazo)-5-pyrazolone 1-(2,4,6-trichlorophenyl)-4-(4-hydroxy-3-methylphenylazo)-3-(2-chloro-5-octadecenylsuccinimidoanilino)-5-pyrazolone

CM-3

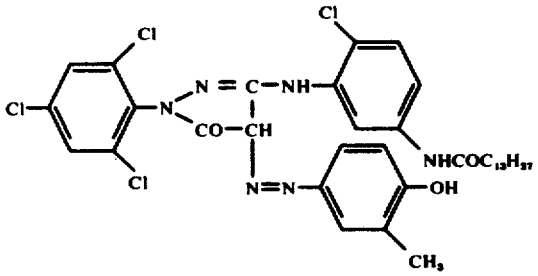

CM - 5

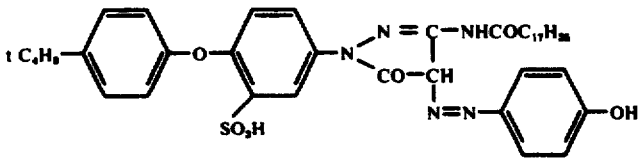

4-(4-hydroxyphenylazo)-3-octadecanoylamido-1-{3-sulfo-(4-tert-butylphenoxy)phenyl}-5-pyrazolone

CM - 6

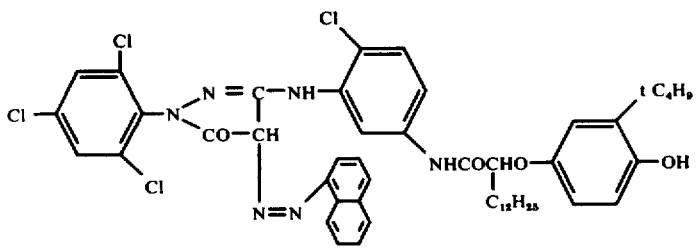

1-(2,4,6-trichlorophenyl)-3-{2-chloro-5-[2-4-hydroxy-tert-amylphenoxy)-tetradecanoylamido]anilino}-4-(1-naphthylazo)-5-pyrazolone

CC-2

CM - 7

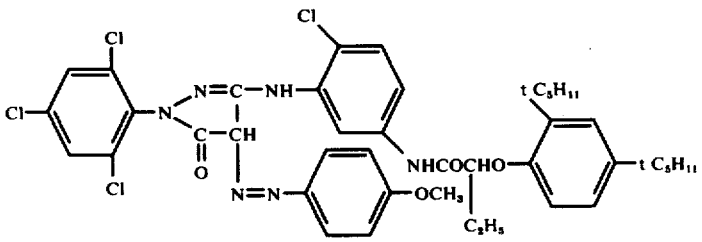

1-(2,4,6-trichlorophenyl)-3-{2-chloro-5-[α-(2,4-di-tert-amylphenoxy)butanamido]anilino}-4-(4-methoxy-phenylazo)-5-pyrazolone As coloured cyan couplers, those that are substituted with arylazo compounds at the active center and are described in U.S. Pat. Nos. 3,034,892; 2,521,908, BP No. 1,255,111, P.A. No. 46-55665, and further masking type couplers which react with a development oxidation product and make the dye flow out into the treating bath and are described in P.A. No. 48-57829, P.A. No. 49-69866, P.A. No. 49-16057, P.A. No. 49-25388, P.A. No. 49-37160, and BP No. 1,084,480 can be used.

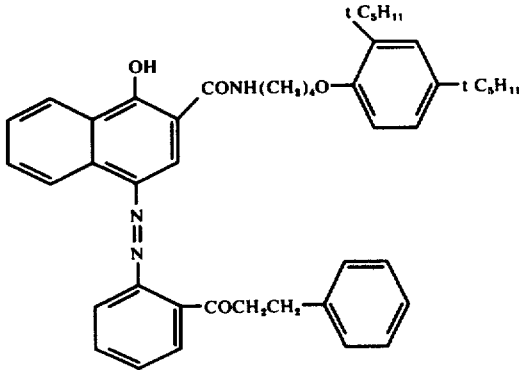

CC - 1

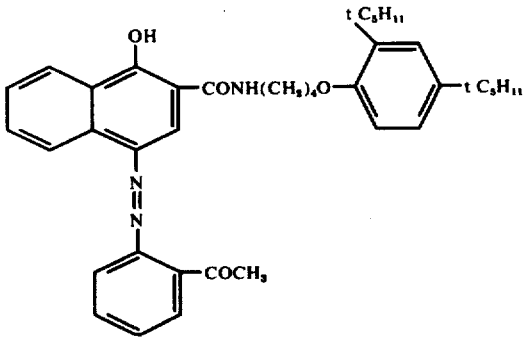

4-(2-acetylphenylazo)-1-hydroxy-N-[4-(2,4-di-tert-amylphenoxy)butyl]-2-naphthoamide 1-hydroxy-N-[4-(2,4di-tert-amylphenoxy)butyl]-4-[2-(2-phenylethylcarbonyl)phenylazo]-2-naphthoamide

CC-3

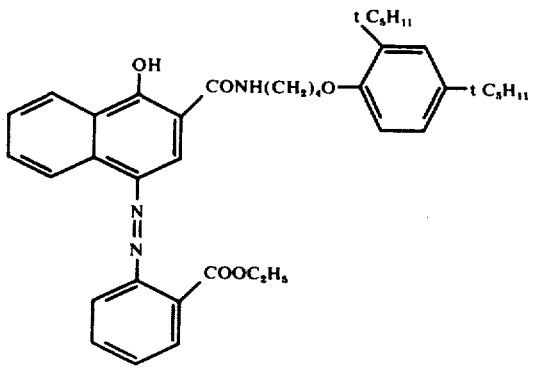

4-(2-ethoxycarbonylphenylazo)-1-hydroxy-N-[4-(2,4di-tert-amylphenoxy)butyl]-2-naphthoamide

CC-4

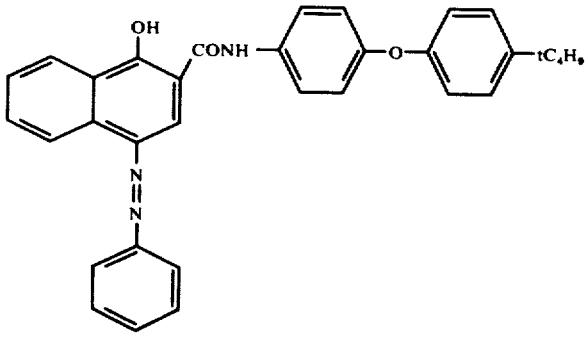

1-hydroxy-4-phenylazo-4'-(4-tert-butylphenoxy)-1-naphthoanilide

CC-5

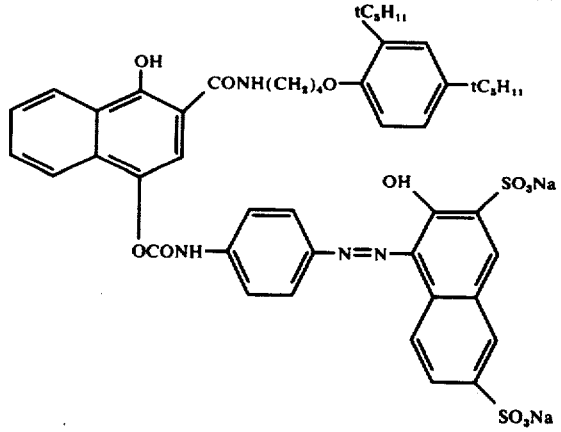

1-hydroxy-4-[4-(2-hydroxy-3,6-disulfo-1-naphthylazo)anilinocarbonyloxy]-N-[4-(2,4-di-tert-amylphenoxy)butyl]-2naphthoamide disodium salt As competing couplers, those described in U.S. Pat. No. 2742832 for example, citrazinic acid can be used. Also as Weiss couplers, those described in DP No. 1155676 can be used too. To incorporate these couplers and the DIR materials used for this invention into light-sensitive silver halide colour photographic materials, several known arts concerning couplers can be applied.

For example, these compounds can be incorporated by dissolving them in high-boiling point solvents as described in U.S. Pat. No. 2322027 or by dispersing couplers and high-boiling point solvents separately in fine particles and then by mixing the dispersed liquids, as described in U.S. Pat. No. 2801170. Also, in these dispersion methods, use of lower-boiling point solvents can be mentioned to be a preferred method. In this case, the DIR materials used for this invention can be dispersed together with couplers or both of them can be separately dispersed. Also, in the case of using lower-boiling point solvents, such a method that is described in U.S. Pat. No. 2801171 or P.A. No. 44-76273 or a method of removing the lower-boiling point solvents from the dispersion solution can be used.

Among the solvents used for this invention, as high-boiling point solvents, there can be preferably mentioned dibutyl phthalate, dioctyl phthalate, diisodecyl phthalate, triphenyl phosphate, tricresyl phosphate, diethyl laurylamide, dibutyl laurylamide, benzyl phthalate, monophenyl-p-t-butylphenylphosphate, phenoxyethanol, diethylene glycol monophenylether, dimethoxyethyl phthalate, hexamethyl phosphoramide and further high-boiling point solvents immiscible with water such as are described U.S. 3779765, P.A. No. 47-130258, P.P. No. 48-29060.

Also, as lower-boiling point solvents, there can be mentioned, for example, methyl isobutyl ketone, ethoxyethyl acetate, trimethoxy triglycol acetate, acetone, methyl acetone, methanol, ethanol, acetonitrile, dioxane, dimethyl formamide, dimethyl sulfoxide, ethyl acetate, butyl acetate, isopropyl acetate, butanol, chloroform, cyclohexane, cyclohexanol, and fluorinated alcohol. These lower-boiling point solvents can be used instead of high-boiling point solvents or by mixing with the latter solvents. Further, these solvent can be used alone or in a mixture of two or more.

Also, as another method, in the case of the couplers and DIR materials having water-soluble radicals, these can be used by dissolving them in alkaline solution, that is, in the Fischer type method or can be added in the same layer by dispersing one of both couplers and DIR materials and by means of the Fischer type method of the other.

As silver halides used for light-sensitive silver halide colour photographic materials according to this invention, any silver halide used for a usual silver halide photographic emulsion such as silver bromide, silver chloro-bromide, silver iodo-bromide, silver chloro-iodide or silver chloride can be used. These silver halides may be rough or fine particles and can be prepared by any one of known methods such as are described in P.L.O. No. 48-65925, P.A. No. 46-18103, P.A. No. 46-7772, U.S. Pat. No. 2592250, U.S. Pat. No. 3276877, FP No. 1557289, U.S. Pat. Nos. 3317322; 2222264; 3320069; 3271157; 3206313; 3367778; 3447927; 2996382; 2184013; 2541472; 3501307; 2563785; 2456953; 2861885; BP No. 723019, FP No. 1520821, J. Phot. Sci., 12,242 – 251 (1964). Silver halides prepared by different methods can be used in a mixture. Further, silver halides used for this invention are used preferably by removing soluble silver halides, but the unremoved silver halide can be used.

As hydrophilic colloids advantageously used for sensitizing emulsions in the light-sensitive silver halide colour photographic materials of this invention, there can be used gelatine, colloidal albumin, agar, gum arabic, alginic acid, hydrolyzed cellulose acetate, acrylamide, imido-polyamide, polyvinyl alcohol, water-soluble polymer such as are described in BP No. 523631, DP No. 2255711, DP No. 2046682, U.S. Pat. No. 3341332, gelatine derivative, for example, phenylcarbamylgelatine, acylated gelatine, phthalated gelatine such as are described in U.S. Pat Nos. 2614928, 2525753, polymer in which gelatine is graft-polymerized with polymerizable monomer having ethylene radical of acrylic acid styrene, acrylate, metacrylic acid, metacrylate such as are described in U.S. Pat. Nos. 2548520, 2831767. These hydrophilic colloids are advantageously used for making photographic material constituent layers, for example, filter layer, protecting layer, intermediate layer and the like.

The three silver halide emulsions applied for the light-sensitive silver halide colour photographic materials of this invention can be sensitized by several chemical sensitizing agents.

As sensitizing agents, there can be used active gelatine, sulfur sensitizing agent (sodium thiosulfate, allylthiocarbamide, thiourea, allylisothiocyanate), selenium sensitizing agent (N,N-dimethylselenourea, selenourea), reduction sensitizing agent (triethylene tetramine, stannic chloride), noble metal sensitizing agent, for example, gold sensitizing agent (potassium chloroaurite, potassium aurothiocyanate, potassium chloroaurate, 2-aurosulfobenzothiazol methylchloride). In the case of using gold sensitizing agents, there can be used ammonium rhodanate as supplemental agent. Also, palladium, platinum, iridium salt sensitizing agents (ammonium chloropalladate, potassium chloroplatinate, sodium chloropalladide) can be used alone or optionally in combination.

The blue sensitive emulsion, the green and red sensitive emulsions can be sensitized optically by using suitable sensitizing dyes in order to give sensitivity for any desired sensitive wave length range to the emulsions. As sensitizing dyes, several kinds of sensitizing dyes can be used alone or in combination of two or more. As sensitizing dyes which are preferably used for this invention, there can be mentioned, for example, methine dyes and styryl dyes such as cyanine, merocyanine, hemicyanine, rhodacyanine, oxonol, hemioxonol dye. Further sensitizing dyes such as are described in the following patents or literatures are mentioned concretely to be effective: U.S. Pat. Nos. 1846301, 1846302, 1939201, 1990507, 2072908, 2112140, 2165338, 2213995, 2269234, 2270378, 2442710, 2454629, 2493748, 2503776 2519001; 2666761; 2739149; 2739964; 2945763; BP No. 424559, BP No. 438420, BP No. 450958, BP No. 505979, DP No. 929080, DP No. 20499467, P.P. No. 43-10251, P.P No. 43-10252, P.P. No. 43-13821, P.P. No. 44-32753, P.P No. 45-27672, P.P. No. 45-27673, P.P. No. 45-27674. P.P. No. 45-27675, P.P. No. 46-18106, P.P. No. 46-18108, P.P. No. 47-8741, P.P. No. 47-23573, P.P. No. 47-37443, P.L.O. No. 48-78930, K.E. Mees and T. H. James: Theory of Photographic Process (3rd. Edition, 1966), and Hahmer: Cyamine dyes and related compounds (1964). Among these patents and literatures, the sensitizing dyes described in the following patents are especially useful for this invention: U.S. Pat. Nos. 2213995; 2503776; 2945763, DP No. 2049967, P.P. No. 43-13821, P.P. No. 44-32753, P.P. No. 46-18108, P.P. No. 47-8741, P.P. No. 47-37443, P.L.O. No. 48-78930, DP No. 929080.

Next, effective sensitizing dyes are exemplified as follows:

Anydrous 3,3'-di-(3-sulfopropyl)selenacarbocyanine hydroxide,

Anhydrous 5,5'-diphenyl-3,3'-di-(3-sulfopropyl)oxacyanine hydroxide,

3-Allyl-5-[1-methyl-2(1H)piperidyliden]rhodanine,

Anhydrous 3'-(4-sulfobutyl)-1'-ethyl-6'-methylselena-2'-cyanine hydroxide,

1-Hydroxyethyl-3-phenyl-5-[3-(3-sulfopropyl)-2-benzooxazolinylidene]ethylidene-2-thiohydantoin sodium salt, Anhydrous 5,5'-dichloro-9-ethyl-3,3'-di-(3-sulfopropyl)oxacarbocyanine hydroxide, Anhydrous 5,5'-diphenyl-9-ethyl-3,3'-di(3-sulfopropyl)oxacarbocyanine hydroxide, Anhydrous 5,5',6,6'-tetrachloro-1,1'-diethyl-3,3'-di-(4-sulfobutyl)-benzoimidazolocarbocyanine hydroxide sodium salt, Anhydrous 5,5'-di-(butoxycarbonyl)-1,1'-diethyl-3,3'-di-(3-sulfopropyl)benzoimidazolocarbocyanine hydroxide, Anhydrous 5,5'-dichloro-1,3'-diethyl-6'-methyl-3-(4-sulfobutyl)benzoimidazoloxacarbocyanine hydroxide, Anhydrous 5,5'-dichloro-9-ethyl-3,3'-di-(2-carboxyethyl)thiacarbocyanine hydroxide, Anhydrous 5,5'-dichloro-3,9-diethyl-3'-(3-sulfopropyl)thiacarbocyanine hydroxide, Anhydrous 5,5'-dimethyl-9-ethyl-3,3'-di-(3-sulfopropyl)thiacarbocyanine hydroxide, Anhydrous 9-ethyl-3,3'-di-(3-sulfopropyl)-4,5,4',5'-dibenzothiacarbocyanine hydroxide, Anhydrous 9-ethyl-3,3'-di-(3-sulfopropyl)-5,6,5',6'-dibenzoxacarbocyanine hydroxide.

In the sensitive silver halide colour photographic materials according to this invention, as usual several photographic additives there can be incorporated the following additives into silver halide emulsion layer or its supplemental layer: Gamma controller, development accelerator, stabilizer, ultraviolet ray absorber, latent image stabilizer, formalin resistance accelerator, image stabilizer, fluorescent brightening agent, anticystein agent, lubricant, metal ion chelating agent, surface active agent, mordant, antistatic agent, agent for preventing colour turbidity, viscosity increasing agent, gelatin plasticizer, latex, matting agent and the like.

As gradient regulators, metals of the 8th group (for example, rhodium, ruthenium) or cadmium and thorium can be used. As development accelerators, benzylalcohol, and polyoxyethylene type compounds can be used and these compounds can be effective when added in the treating bath. As stabilizers, those compounds which are described in U.S. Pat. Nos. 2,444,607; 2,716,062; 3,512,982, DP No. 1,189,380, DP No. 2,058,626, DP No. 2,118,411, P.P. No. 43-4135, U.S. Pat. No. 3,342,596, P.P. No. 47-4417, DP No. 2,149,789, P.P. No. 39-2825, P.A. No. 45-77072 can be used. As especially preferred compounds, there can be mentioned 5,6-trimethylene-7-hydroxy-s-triazolo (1,5-a)pyrimidine, 5,6-tetramethylene-7-hydroxy-s-triazolo(1,5-a)pyrimidine, 5-methyl-7-hydroxy-s-triazolo-(1,5-a)pyrimidine, 7-hydroxy-s-triazolo (1,5-a) pyrimidine, 5-methyl-6-bromo-7-hydroxy-s-triazolo (1,5-a) pyrimidine, gallic acid ester (for example, isoamyl gallate, dodecyl gallate, propyl gallate, sodium gallate), mercaptans (1-phenyl-5-mercaptotetrazol, 2-mercaptobenzothiazol), benztriazoles (5-bromobenztriazole, 4-methylbenztriazole) benzimidazoles (6-nitrobenzimidazole). As ultraviolet ray absorbers, those compounds which are described in P.P. No. 48-763, P.P. No. 48-5496, P.P. No. 48-41572, P.P. No. 48-30492, P.P. No. 48-31255, U.S. Pat. No. 3,253,921, BP No. 1,309,349 can be used. Among these compounds, such an ultraviolet ray absorber as Tinuvin PS, Tinuvin 320, Tinuvin 326, Tinuvin 327, Tinuvin 328 manufactured by Ciba & Geigy Company Ltd. can be used effectively alone or a combination of them. As latent image stabilizers, sulfur containing compounds such as are described in DP No. 2,217,153, DP No. 2,217,895, nitrogen containing compounds and heterocyclic compounds such as are described in P.L.O. No. 49-14120, P.L.O. No. 49-29835 can be used. As formalin resistance accelerators, those compounds which are described in Belgium Pat. No. 801,533 P.A. No. 48-134036, P.P. No. 46-34675 can be used. Among these compounds, a combination of vinylsulfone type hardening agent and non-cyclic urea derivative which are described in Belgium Pat. No. 801,533 and P.A. No. 48-134036 are effective.

As image stabilizers, there can be used chroman type compounds described in U.S. Pat. No. 3,432,300, chroman and coumaran type compounds described in U.S. Pat. No. 3,574,627, bisphenol type compounds described in P.P. No. 48-31256, P.P. No. 48-31625 and phosphorous acid ester type compounds described in P.P. No. 48-32728. Among these compounds, those described in P.P. No. 48-31256, P.P. No. 48-31625 are effective, for example, 6,6'-butylidene bis(2-ter-butyl-4-methylphenol), 4,4'-methylene bis-(2,6-di-tert-butylphenol), and 2,2'-dimethyl-4,4'-dihydroxy-5,5'-di-tert-butyl-diphenylsulfide can be mentioned. As fluorescent brightening agents, for example, these compounds which are described P.P. No. 34-7127 can be used. As anticystein agents, those compounds described in U.S. Pat. Nos. 2,732,300; 3,700,453; 2,360,210, 2,728,659 can be used. Among them, those compounds described in U.S. Pat. Nos. 2,732,300, 2,360,210, for example, 2-methyl-5-hexadecyl-hydroquinone, 2-methyl-5-sec-octadecylhydroquinone or their combination use are effective. As lubricants, wax, higher aliphatic acid glyceride, higher aliphatic acid higher alcohol ester (for example, those described in U.S. Pat. No. 3,121,060) can be used. As metal ion masking agents, ethylenediamine tetraacetic acid or those compounds described in DP No. 1,160,302, DP No. 1,170,777, DP No. 1,187,132, U.S. Pat. No. 3,236,652, P.A. No. 48-45113, P.A. No. 48-52094 can be used. Among them, those described in P.A. No. 48-45113, P.A. No. 48-52094 are effective. As surface active agents, anionic type, cationic type, non-ionic type or amphoteric ion type compounds can be used. As improving agents against coating supplemental agents, emulsion and treating liquid or as materials for the control of several physical properties of aniforming agent or photographic material, for example, active surface agents described in BP No. 548,532, BP No. 1,216,389, U.S. Pat. Nos. 3,026,202, 3,514,293, P.P. No. 44-26580, P.P. No. 43-17922, P.P. No. 43-17926, P.P. No. 40-376, P.P. No. 43-13166, P.P. No. 43-43130 P.L.O. No. 48-20785, P.L.O. No. 47-18338, P.A. No. 47-89630, FP No. 2,025,688, Belgium Pat. No. 773,459 are effective. Among them, there can be mentioned to be specially preferred: Anionic active agents such as sodium alkyl-sulfosuccinate (for example, sodium di-2-ethylhexylsulfosuccinate or sodium amyldecylsulfosuccinate), sodium alkylbenzenesulfonate (for example, sodium dodecylbenzenesulfonate), sodium alkylnaphthalenesulfonate (for example, sodium triisopropylnaphthalenesulfonate), non-ionic active agents such as saponin, polyethylene glycol, alkylphenoxypolyethylene glycol, alkylphenoxypolyglycidol sugar aliphatic acid ester, organosiloxane (for example, polone SR manufactured by Shinetsu Chemical Company Ltd., L-76 or L-520 manufactured by Union Carbide Company Ltd.,), amphoteric ion active agents such as sodium alkyl-phenoxypolyethyleneglycol sulfonate (for example, sodium p-t-octylphenoxypolyethyleneglycol sulfonate), N-alkyl-N,N-dipolyoxyethylene-N-carboxymethyl-betaine (for example, N-lauryl-N,N-dipolyoxyethylene-N-carboxyl betaine) or non-ionic, anionic, cationic or betaine type active agents containing fluorinated alkyl radical (for example, FC-134, FC-172 manufactured by 3M Company Ltd.,). These active agents can be used alone or in combination of several compounds such as is described in P.L.O. No. 48-101118. As mordants, there can be used N-guanylhydrazone type compounds described in U.S. Pat. No. 2,882,156, DP No. 2,113,381, quaternary oniumchloride compounds described in U.S. Pat. Nos. 2,548,564, 3,444,138, BP No. 786,592, P.P. No. 43-10254, tertiary amine or quaternary oniumchloride compounds described in U.S. Pat. No. 2,675,316, BP No. 1,221,195, B.P. No. 1,221,131. Among them, those compounds described DP No. 2,113,381, U.S. Pat. No. 2,548,564 are effective. As antistatic agents, there can be used those compounds described in P.P. No. 46-24159, P.P. No. 46-39312, P.P. No. 48-43809, P.P. No. 49-4853, P.P. No. 49-64, P.P. No. 47-8742, P.P. No. 48-43130, P.L.O. No. 48-89979, P.L.O. No. 48-90391, P.L.O. No. 48-20785, P.L.O. No. 47-33627, P.A. No. 47-115641, U.S. Pat. Nos. 2,882,157, 2,979,535. Among them, those compounds described in P.L.O. No. 48-89979, P.L.O. No. 48-90391, P.A. No. 46-24159, P.L.O. No. 47-33627, for example, diacetyl cellulose, styrene-perfluoroalkylsodium maleate copolymer, alkali salt of reaction product of styrene-anhydrous maleic anhydride co-polymer and aminobenzenesulfonic acid, addition product of p-xylidenedichloride and N,N,N',N'-tetramethyltrimethylenediamine are effective.

As agents for preventing colour turbidity (bad desilverization inhibitors) there can be used a polymer containing vinylpyrrolidene (for example, those described in BP No. 1,052,487), polymer containing vinyl oxazolidinones (for example, those described in BP No. 1,070,688), a polymer containing vinyl imidazole (for example, B.P. No. 1,080,976). As matting agents, those described in BP 1,221,980, for example, methyl polymetacrylate, polystyrene, alkali soluble polymer, for example, metacrylic acid - methyl metacrylate copolymer are effective. Further, the use of colloidal silicon oxide is possible.

As latex incorporated in order to improve film physical properties, there can be used a copolymer of an acrylate ester, or a vinyl ester and a monomer having another ethylene radical. As gelatin plasticizers, there can be used glycerol or compounds described in U.S. Pat. No. 2,960,404, P.P. No. 43-4939, P.P. No. 45-15462, P.L.O. No. 48-63715, DP No. 1,904,604, and Belgium Pat. No. 762,833. As viscosity increasing agents, there can be used a styrene-sodium maleate copolymer, alkylethylenevinylmaleic acid copolymer and those compounds described in U.S. Pat. No. 3,767,410, Belgium Pat. No. 558,143.

The light-sensitive silver halide colour photographic materials can be provided with supplemental layers such as a filter layer, antihalation layer and irradiation layer and in these layers dyes which are flown out of photographic materials by means of development treatment or bleached can be caused to incorporate. As representative dyes of this kind can be used dyes such as cyanine, merocyanine, styryl, benzylidene, sinamylidene, oxanol, azo, anthraquinone, and triphenylmethane dye.

As dyes used effectively for this invention, there can be mentioned those dyes such as are described in U.S. Pat. Nos. 1,884,035; 2,150,695; 2,172,262; 2,241,239; 2,298,731; 2,298,733; 2,322,006; 2,527,583; 2,011,696; 2,622,082; 2,091,579; 2,739,888; 2,865,752; 2,956,879; 3,247,127; P.P. No. 28-5731, P.P. No. 31-5920, P.P. No. 31-10578, P.P. No. 39-22069, P.P. No. 43-13168, B.P. No. 396,646, BP No. 446,583, BP No. 506,385, BP No. 515,998, BP No. 646,125, and BP No. 1,128,113. Among them, those compounds described in U.S. Pat. Nos. 1,884,035; 2,865,752; 2,956,879, P.P. No. 39-22069, P.P. No. 43-13168 and BP No. 506,385 are especially effective.

Effective dyes are exemplified as follows:

Bis-[3-methyl-1-(4'-sulfophenyl-2-pyrazoline-5-one-4-yl]monomethyleneoxonol dipotassium salt, Tartrazine (C.I.: Acidoyellow-23), 4-(p-dimethylaminobenzylidene)-3-methyl-1-(p-sulfophenyl)-2-pyrazoline-5-one sodium salt, bis-[3-carboxy-1-(4-sulfophenyl)-2-pyrazoline-5-one-4-yl]trimethyleneoxonol dipotassium salt, 2-(p-dimethylamynostyryl)-1-(4-sulfobenzyl)-6-sulfobenzothiazolium hydroxide, fuchsine-S' (C.I.: Acidoviolet-19), edible red 102 or Brilliant Scarlet 3R (C.I.: acidored 18), bis-[3-methyl-1-(4-sulfophenyl)-2-pyrazoline-5-one-4-yl]-pentamethyleneoxonol dipotassium salt, bis-[3-methyl-1-(2-hydroxy-3-carboxy-5-sulfophenyl)-2-pyrazoline-5-one-4-yl]-pentamethyleneoxonol dipotassium salt, Alizarineserestol R (C.I.: 63325), anhydrous 4-[(4-dimethylaminophenyl)(3,4-disulfomethylphenyl)-methylene]-2,5-cyclohexadiene-1-dimethyliminium hydroxide sodium salt.

The light-sensitive silver halide colour photographic materials can be prepared by coating the silver halide emulsion layers containing the several photographic additives as described above and other constituent layers on supports, if necessary. As supports used to be preferred, there are, for example, baryta paper, paper with polyethylene, polypropylene synthetic paper, glass plate, cellulose acetate, cellulose nitrate, polyvinyl acetal, polypropylene, polyester film such as polyethylene terephthalate, polyamide film, polycarbonate film, and polystyrene. These supports can be adequately chosen according to the use objects of the light-sensitive silver halide colour photographic materials.

The supports can be, if necessary, under-coated. As representative under-coating materials, there can be mentioned a copolymer of vinyl chloride or vinylidene chloride, copolymer of ester of vinylalcohol, copolymer of acrylic acid or metacrylate esters, copolymer containing unsaturated carboxylic acid, copolymer of dienes such as butadiene, copolymer of acetals, copolymer of unsaturated carboxylic anhydrides such as maleic anhydride, especially vinylalcohol esters such as vinyl acetate or copolymer of styrene or compounds thereof ring-opened with water, alcohols or amines, cellulose derivatives such as nitrocellulose, diacetyl cellulose, compounds containing epoxy radicals, gelatine or deformed gelatine and polyolefin copolymer. These compounds are described in P.P. No. 48-14434, P.P. No. 47-12433, P.P. No. 48-9965, P.P. No. 48-3564, P.P. No. 48-14185, P.P. No. 47-35458, P.P. No. 47-35459, P.L.O. No. 47-37921, P.L.O. No. 47-14274, P.L.O. No. 48-24723, P.L.O. No. 48-93672, and P.L.O. No. 48-89979. These under-coating materials can be used alone or, if necessary, in combination of them. As described in P.P. No. 48-43122, P.P. No. 48-24270, P.L.O. No. 48-26124, these materials can be mixed with gelatine or polyols. Further, mono or polyphenols and their chloro-substituted compounds, cross linking agents (hardening agent) and metal oxides can be used (for example, P.L.O. No. 48-23862, P.L.O. No. 48-592). In the case of under-coating of the above materials, they may be used alone, but a method of under-coating successively with a layer comprising the above materials, a mixed layer of gelatine and the above materials and a gelatine layer or a method of under-coating one of the former two layers and a gelatine layer can be effected and, if necessary, multilayer coating can be effected by increasing layers and any method can be adopted according to the object. Also, as described in P.L.O. No. 48-85126, P.L.O. No. 48-93672, P.L.O. No. 47-19824, the treatments such as corona discharge, glow discharge, other electric impact, fire flame treatment, surface roughing and ultraviolet ray irradiation can be applied on the support surface alone or in combination. Further these surface treatments can be applied together with the above material treatments.

The light-sensitive silver halide colour photographic materials can be colour-developed by means of a usual colour development process after exposure. In the case of a reversal process, they are developed with a white and black negative developer and then exposed to white rays or developed with a bath containing a nucleating agent and then colour-developed with an alkaline developer containing a colour developing agent.

The treatment processes are not limited and any treatment process can be applied. As representative processes, there can be applied, for example, a process such as is described U.S. Pat. No. 3582322 which comprising, after colour development, combined bleaching and fixing and, if necessary, washing with water and stabilizing and a process such as is described in U.S.T. 910002 which comprising, after colour development, bleaching and fixing separately and, if necessary, washing with water and stabilizing.

As there is known a process for treating lower silver content photographic material by means of an amplifying agent such as hydrogen peroxide or a cobalt complex and such a process can be applied. Also, in the case of treating with such a process, there is a case at which the treatment is effected in higher temperature and a case of treatment at room temperature or in especial case a temperature lower than room temperature.

In the case of a high temperature treatment, the prehardening treatment such as is described in U.S. Pat. No. 3342596 can be adopted. Also, according to kinds of treating agent, supplemental baths such as several neuralizing baths are necessary in certain circumstances and, if necessary, these supplemental baths can be optionally used. As processes for practical use of such treatments, there are known Flexcolour chemicals, 3-Chemicals and Me-4 of Eastman Kodak Company Ltd. This invention exhibits enough effect with these treatments, but does too when these treatment are changed or amended.

There can be adopted several methods of transferring light-sensitive materials and accordingly there can be used several treatment processors such as a machine lift and drain processor continuous, sinuosidal-pass processor, roler transport processor and belt transport processor.

As a special system such as is described in P.P. No. 35-1885, P.P. No. 36-16989, U.S. Pat. No. 3189452, P.P. No. 46-40908 and U.S. Pat. No. 3607277, a process which comprises, without dipping the light-sensitive materials into a treating bath, coating or spraying the treating liquid on the light-sensitive material is effective for treating the light-sensitive silver halide colour photographic materials of this invention.

Also, there is developed a method of reproduction for use of treating liquids, and a recovering method of medicals which are important pollutionally or in sources and these apparatuses are often provided with these treatment apparatuses and the photographic materials are optionally treated by these apparatuses. The treating agents for use are not limited and usual agents can be used and as developing principal components there are mentioned as follows:

3-Acetamido-4-amino-N,N-diethylaniline,
p-Amino-N-ethyl-N-(β-hydroxyethyl)aniline sulfate,
N,N-diethyl-p-phenylenediamine,
2-Amino-5-diethylaminotoluene,
N-ethyl-N-( β-methanesulfonamidoethyl)-3-methyl-4-aminoaniline,
4-Amino-3-methyl-N-ethyl-N-β-ethoxyethylaniline,
4-Amino-N-ethyl-3-methyl-N-(β-sulfoethyl)aniline,
4-Amino-N,N-diethylaniline hydrochloride,
4-Amino-3-methyl-N,N-diethylaniline hydrochloride,
4-Amino-3-methyl-N-ethyl-N- β-(methanesulfonamido)-ethylaniline sulphate hydrate,
4-Amino-3-methyl-N-ethyl-N-β-hydroxyethylaniline sulfate,
4-Amino-3-dimethylamino-N,N-diethylaniline sulfate hydrate,
4-Amino-3-methoxy-N-ethyl-N-β-hydroxyethylaniline hydrochloride,
4-Amino-3-β-(methanesulfonamido)ethyl-N,N-diethylaniline dihydrochloride,
4-Amino-N-ethyl-N-(2-methoxyethyl)-m-toluidine sulfonate.

Especially useful developing agents are described in, for example, P.L.O. No. 48-64932, J. Am. Chem. Soc., 73 3100 – 3125 (1951), K. E. Mees and T. H. James: Theory of Photographic Processes, 3rd Ed., 278 – 311 (1966).

As bleaching agents, there can be used bichromate, hexacyanoferrate, permanganate, ferrichloride, halogen, persulphuric acid, hydrogen peroxide or polyaminocarboxylic acid, for example, iron complex of EDTA (ethylenediaminetetraacetic acid, trichloroacetic acid iron salt or tartaric acid iron salt such as are described in DP No. 866605, cobalt salt such as is described in DP No. 954475, Bp No. 777635. Also there can be used compounds described in U.S. Pat. Nos. 2507183 and 2529981 as bleaching agents of quinone type, those described in U.S. Pat No. 2705201 as nitroso compounds, those described in BP No. 774194, P.P. No. 35-1478, BP No. 1032024 as copper complex salts, those described in U.S. Pat. No. 3264107, BP No. 41-11068 as halogeno-acid type compounds and these bleaching compounds can be effectively used. There can be used known fixing agents such as a thiosulfate salt, thiocyanic salt, for example, thioetherpolycarboxylic acid such as described in U.S. Pat. No. 2748000, bissulfonylalkane type compound such as is described in P.L.O. No. 47-330.

Several accelerators of other bleaching or fixing agents can be used effectively. These accelerators can be used especially in a bleach-fixing bath in many times. As representative compounds, there can be used a polyethylene oxide type, thiourea type, mercapto type, amine type, onium type and selenium type. For example, those described in BP No. 746567, P.P. No. 45-8506, BP No. 1138842, P.P. No. 45-8836, P.P. No. 46-556, DP No. 2139401, P.L.O. No. 46-280, P.L.O. No. 47-7324, and P.L.O. No. 47-7325 are especially effective.

In the case of preparing practical treating liquids using these medicals, there can be used several supplemental medicals, for example, phosphoric acid, acetic acid, citric acid, tartaric acid, boric acid and alkali metal salt or ammonium salt. And antioxidants, development accelerator can be usually incorporated into developers. According to this invention the treatments using these medicals can be used effectively.

In the light-sensitive silver halide colour photographic materials according to this invention, a useful amount of DIR materials having the above formula varies with the applied principal object, that is, interimage effect or intraimage effect or with the kinds of emulsions or compounds used, but an amount of 0.1 – 10 g per/kg of emulsion is preferred and a remarkably great image effect can be obtained when they are used in a smaller amount in comparison with known DIR compounds. An amount of hardening agent used together with them is not limited, but its amount is generally in a range of 0.01 – 100 g per dry gelatine, especially 0.01 – 10 g per dry gelatine is preferred.

Then, this invention will be illustrated in detail by the following examples but they are not meant to limit the scope of this invention.

EXAMPLE 1

Light-sensitive material-A

In a mixture of 20 ml of tricresyl phosphate and 60 ml of ethyl acetate, 15 g of the exemplified M-1 coupler and 5 g of CM-1 coupler were added. The mixture was dissolved completely by heating at 60° C. This solution was mixed with 5 ml of a 10% aqueous solution of Alkanol B (alkylnaphthalenesulfonate manufactured by Du Pont de Nemours & Co.) and 200 ml of aqueous gelatine solution and was emulsified by means of a colloid mill to obtain coupler dispersion solution. This dispersion solution was added to 1 Kg of green-high sensitive silver iodobromide gelatine emulsion and, after adding a usual stabilizer and extender, 10 mg/g of gelatin of mucochloric acid (exemplified compound, H-5) was added to the emulsion. This mixture was coated on cellulose acetate film base and dried to obtain the desired light-sensitive material.

Light-sensitive material-B

This sensitive material was prepared in the same manner as in the sensitive material-A except that 1.0 g of 2-ethoxy-5-oxo-1-{4-[2-(3-n-pentadecylphenoxy)-butyrylamido]-phenyl}-4-(1-phenyl-5-tetrazolylthio)-

2-pyrazoline coupler was incorporated into the light-sensitive material-A.

Light-sensitive material-C

This light-sensitive material was prepared in the same manner as in the light-sensitive material-A except that 1.0 g of the exemplified compound D-4 was incorporated into the light-sensitive material-A.

After preparation of the respective light-sensitive material, they were at once exposed through light edge and colour-developed by the following treatments.

| Treatment procedure (38° C) | Treating time |
|---|---|
| Colour development | 3 minutes 15 seconds |
| Bleaching | 6 minutes 30 seconds |
| Washing with water | 3 minutes 15 seconds |
| Fixing | 6 minutes 30 seconds |
| Washing with water | 3 minutes 15 seconds |
| Sabilizing | one minutes 30 seconds |

The compositions of the treating solutions in the above treatment procedures are as follows:

| | |
|---|---|
| 4-Amino-3-methyl-N-ethyl-N-(β -hydroxyethyl)-aniline sulfate | 4.8 g |
| Anhydrous sodium sulfite | 0.14 g |
| Hydroxylamine . ½ sulfate | 1.98 g |
| Sulfuric acid | 0.74 mg |
| Anhydrous potassium carbonate | 28.85 g |
| Anhydrous potassium hydrogen carbonate | 3.46 g |
| Anhydrous potassium sulfite | 5.10 g |
| Potassium bromide | 1.16 g |
| Sodium chloride | 0.14 g |
| Nitrilotriacetic acid . 3 sodium salt (monohydrate) | 1.20 g |
| Potassium hydroxide | 1.48 g |
| Water | to 1 l |

Composition of the bleaching solution:

| | |
|---|---|
| Ethylenediamine tetraacetic acid iron ammonium salt | 100.0 g |
| Ethylenediamine tetraacetic acid 2 ammonium salt | 10.0 g |
| Ammonium bromide | 150.0 g |
| Glacial acetic acid | 10.0 ml |
| Water | to 1 l |
| and the solution was adjusted to pH 6.0 with aqueous ammonia | |

Composition of the fixing solution:

| | |
|---|---|
| Ammonium thiosulfate | 175.0 g |
| Anhydrous sodium sulfite | 8.6 g |
| Sodium metasulfite | 2.3 g |
| Water | to 1 |
| and the solution was adjusted to pH 6.0 with acetic acid. | |

Composition of the stabilizing solution:

| | |
|---|---|
| Formalin (37 % aqueous solution) | 1.5 ml |
| Konidax (manufacture by Konishiroku Photo Industry Co., Ltd.) | 7.5 ml |
| Water | to 1 l |

Then, sensitivity (S), fog (F), Gamma (γ), maximum density (Dm) and granularity of the colour images formed on the respective light-sensitive materials were measured. Further, after the light-sensitive materials were thermo-treated at 55° C in the relative humidity 80% for 3 days and then treated in the same manner as described above, the photographic characteristics were measured. The results are shown in Table 1. The sensitivity in Table 1 is represented by defining the relative sensitivity of the light-sensitive material just after the preparation as 100. Also the granularity is represented by defining as 1000 times of variable standard difference of density value which occurred during screening with microdensitometer having 25 μ of circular screening diameter.

Table 1

| Light-sensitive material | Just after preparation | | | | After thermo-treatment | | | | Granularity (RMS) |
|---|---|---|---|---|---|---|---|---|---|
| | S | F | γ | Dm | S | F | γ | Dm | |
| A | 100 | 0.12 | 0.9 | 2.0 | 96 | 0.16 | 0.88 | 2.0 | 56 |
| B | 65 | 0.07 | 0.7 | 1.5 | 30 | 0.23 | 0.52 | 1.3 | 43 |
| C | 95 | 0.06 | 0.85 | 1.9 | 95 | 0.10 | 0.84 | 1.8 | 41 |

As is clear from Table 1, the granularity of the light-sensitive material A is inferior and the colour sensitibity of the light-sensitive material-B is low and its desensitivity is further increased by thermo-treatment and abnormal occurrence of fog was recognized. But as is understood from the Table the light-sensitive material-C according to this invention showed very good results without desensitivity.

EXAMPLE 2

The following layers were successively placed on the support made of cellulose acetate film, thus obtaining the light-sensitive-D.

Layer-1 Halation inhibiting layer

Black colloidal silver was dispersed in an aqueous gelatine solution and the dispersed solution was coated on the film in the ratio of 3 g/m² of gelatine and 0.3 g/m² of silver.

Layer-2 Cyan forming red-sensitive silver halide emulsion layer

In tricresyl phosphate a mixture of 5 g of the coupler (CC-5), 20 g of (C-1) and 2 g of DIR material (D-5) was dissolved and the solution was dispersed into an aqueous gelatine solution. The silver iodo-bromide gelatine emulsion containing the above dispersed solution was coated on the film in the ratio of 4.5g/m² of gelatine, 3.4 g/m² of silver and 1.4 g/m² of the cyan coupler.

Layer-3 Intermediate layer

An aqueous gelatine solution was coated in the ratio of 1.3 g/m² of gelatine

Layer-4 Magenta forming green-sensitive silver halide emulsion layer

In tricresyl phosphate a mixture of 25 g of the exemplified coupler (M-3), 5 g of CM-2 and 2 g of the DIR material (D-4 ) was dissolved and the solution was dispersed into an aqueous solution of gelatine. The silver iodo-bromide gelatine emulsion (containing 6 mole % of silver iodo-bromide) comprising the said dispersed solution was coated on the film in the ratio of 5.0 g/m² of gelatine, 3.2 g/m² of silver and 1.2 g/m² of a mixture of the DIR materials as magenta coupler.

Layer-5 Intermediate layer

An aqueous solution of gelatine was coated on the film in the ratio of 1.3 g/m² of gelatine.

Layer-6 Yellow filter layer

Yellow colloidal silver was dispersed into an aqueous solution of gelatine and the dispersed solution was coated on the film in the ratio of 0.1 g/m² of silver and 1.3 g/m² of gelatine.

Layer-7 Yellow forming blue-sensitive silver halide emulsion layer

In dibutyl phthalate 30 g of the exemplified coupler (Y-5) was dissolved and dispersed into an aqueous solution of gelatine. The silver iodo-bromide gelatine emulsion (containing 7 mole % silver iodo-bromide) comprising the above dispersed solution was coated on the film in the ratio of 4.0 g/m² of gelatine, 1.0 g/m² of silver and 1.6 g/m² of yellow coupler.

Layer-8 Protecting layer

An aqueous solution of gelatine was coated on the film in the ratio of 1.3 g/m² .

As hardening agent of the respective layers 1,2-bis(-vinyl sulfonyl)ethane (the exemplified compound, H-22) was incorporated into the layers in the ratio of 20 mg per g of gelatine.

On the other hand, as controlling sensitive materials the light-sensitive material-E was prepared in the same manner as in the light-sensitive material-D except that 1-oxy-4-(1-phenyl-5-tetrazolylthio)-N-(2-n-tetradecyloxyphenyl)-2-naphthoamide was used instead of the DIR material in layer-2 of the light-sensitive material D and 3-ethoxy-5-oxo-1-{4-[2-(3-n-pentadecylphenoxy) butanamido]-phenyl}-4-(1-phenyl-5-tetrazolylthio) 2-pyrazoline instead of the DIR material in layer-4.

These light-sensitive materials were respectively exposed in a usual manner and treated in the same way as in example 1 and then the photographic characteristics of magenta and cyan images were measured. The results were shown in Table 2. In Table, M represents magneta colour image, C represents cyan colour image and the sensitivity is relatively represented by defining that of the light-sensitive material as 100.

Table 2

| Light-sensitive material | S | | F | | Dm | | Granularity (RMS) | |
|---|---|---|---|---|---|---|---|---|
| | M | C | M | C | M | C | M | C |
| D | 100 | 100 | 0.14 | 0.11 | 2.1 | 1.8 | 45 | 60 |
| E | 95 | 92 | 0.16 | 0.13 | 1.8 | 1.6 | 48 | 65 |

As is clear from Table 2, the light-sensitive material-D according to this invention is superior to the light-sensitive material-E in any point of sensitivity, fog and granularity.

What is claimed is:

1. A light-sensitive silver halide colour photographic material, which comprises a development releasing inhibitor compound which liberates a development inhibiter and simultaneously produces a colorless compound on reacting with an oxidation product of a color developing agent, and a photographic hardening agent, said development releasing inhibitor compound comprising:

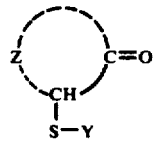

wherein Z, together with the

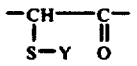

group, represents an alicyclic ring selected from the group consisting of 5-, 6- and 7-membered rings; and a heterocyclic ring selected from the group consisting of a piperidone, a lactone having a 4- to 7-membered ring, a pyrrolidone, a hydantoin and an oxyindole, each of which ring may be substituted and may have condensed rings, and Y represents a group that forms a development inhibitor when the sulfur atom of the thioether bond is split from the said ring to release an aryl mercapto compound, a heterocyclic mercapto compound, a thioglycol, cysteine or glutathione, and said hardening agent is selected from the group consisting of

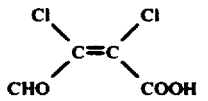

$H_2CSO_2CH_2CH_2CH_2OSO_2CH_2$.

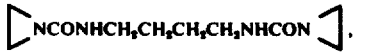

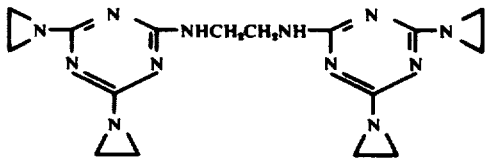

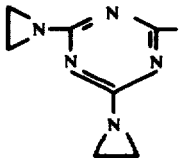

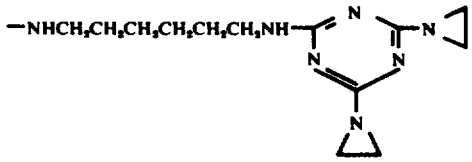

-continued

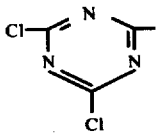

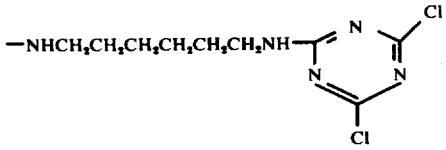

$H_2C{=}CHSO_2CH{=}CH_2$, $H_2C{=}CHSO_2CH_2SO_2CH{=}CH_2$, $H_2C{=}CHSO_2CH_2CH_2SO_2CH{=}CH_2$, $H_2C{=}CHSO_2CH_2CH_2CH_2SO_2CH{=}CH_2$,

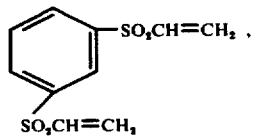

and

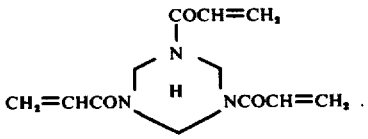

2. A light-sensitive silver halid colour photogrphic material as claimed in claim 1, wherin Z is, together with the

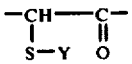

group, an alicyclic ring or heterocyclic ring containing an oxygen, nitrogen or sulfur atom, which ring has 5, 6 or 7 atoms, is saturated or unsaturated, and is unsubstituted or substituted with one or more of alkyl, aryl, alkoxyl, acyl, alkoxy-carbonyl, halogen, cyano, nitro, sulfonamido, acylamino and -S-Y radicals, and may form a condensed ring.

3. A light-sensitive silver halide colour photographic material as claimed in claim 2, wherein Z, together with the

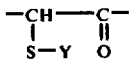

group, is selected from the groups consisting of cyclopentanone, cyclohexanone, cyclohexenone, 2-, 3- and 4-piperidone, a lactam having a 5, 6, or 7 membered ring, pyrrolidone, hydantoin, thiohydantoin, indanone, benzcyclohexenone, benzcycloheptenone and oxyindole.

4. A light-sensitive silver halide colour photographic material as claimed in claim 1 wherein —S—Y represents a radical capable of splitting off and forming a compound having development inhibiting action selected from the group consisting of 1-phenyl-2-mercaptotetrazole, 1-nitrophenyl-5-mercaptotetrazole, 1-naphthyl-5-mercaptotetrazole, 2-mercaptothiazole, mercaptobenzthiazole, mercaptonaphthothiazole, mercapto-oxadiazole, mercaptopiperidine, 2-mercaptothiadiazolotriazine, mercaptotriazine, mercaptobenzene, 1-mercapto-2-benzoic acid, 1-mercapto-2-nitrobenzene, and 1-mercapto-3-heptadecanoylaminobenzene.

5. A process for developing an imagewise exposed light-sensitive silver halide photographic material in the presence of a development releasing inhibitor compound, which liberates a development inhibitor and simultaneously produces a substantially colorless compound on reacting with an oxidation reaction product of a color developing agent, and a photographic hardening agent, said development releasing inhibitor compound comprising:

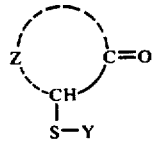

wherein Z, together with the

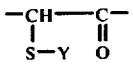

group, represents an alicyclic ring selected from the group consisting of 5-, 6- and 7-membered rings, and a heterocyclic ring selected from the group consisting of a piperidone, a lactone having a 4- to 7-membered ring, a pyrrolidone, a hydantoin and an oxyindole, each of which ring may be substituted and may have condensed rings, and Y represents a group that forms a development inhibitor when the sulfur atom of the thioether bond is split from the said ring to release an aryl mercapto compound, a heterocyclic mercapto compound, a thioglycol, cysteine or glutathione, and said hardening agent is selected from the group consisting of

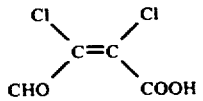

$H_3CSO_2CH_2CH_2CH_2OSO_2CH_3$,

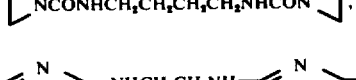

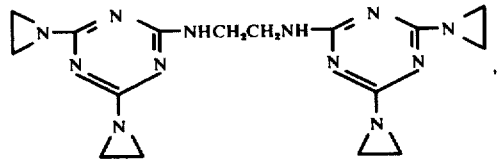

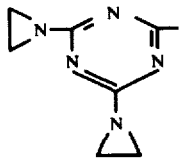

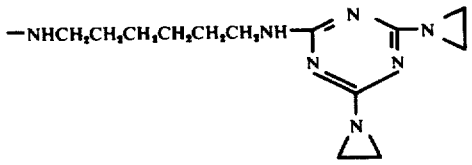

-continued

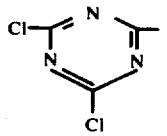

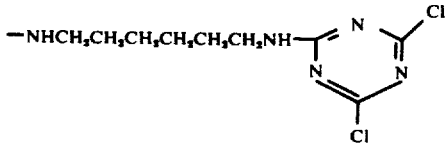

$H_2C{=}CHSO_2CH{=}CH_2$, $H_2C{=}CHSO_2CH_2SO_2CH{=}CH_2$, $H_2C{=}CHSO_2CH_2CH_2SO_2CH{=}CH_2$, $H_2C{=}CHSO_2CH_2CH_2CH_2SO_2CH{=}CH_2$,

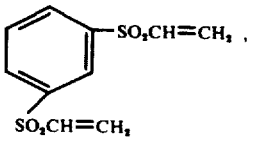

and

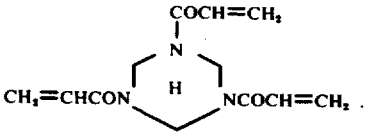

6. A process as claimed in claim 5, wherein Z together with the

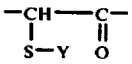

group is an alicyclic ring or heterocyclic ring containing an oxygen, nitrogen or sulfur atom, which ring has 5, 6, or 7 atoms, is saturated or unsaturated, and is unsubstituted or substituted with one or more of alkyl, aryl, alkoxyl, acyl, alkoxycarbonyl, halogen, cyano, nitro, sulfonamido, acylamino and -S-Y radicals, and may form a condensed ring.

7. A process as claimed in claim 6, wherein Z together with the

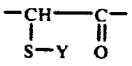

group is selected from the group consisting of cyclopentanone, cyclohexanone, cyclohexenone, 2-, 3- and 4-piperidone, a lactam having a 5, 6, or 7 membered ring, pyrrolidone, hydantoin, thiohydantoin, indanone, benzcyclohexenone, benzcycloheptenone and oxyindole.

8. A process as claimed in claim 5, wherein —S—Y represents a radical capable of splitting off and forming a compound having development inhibiting action selected from the group consisting of 1-phenyl-2-mercaptotetrazole, 1-nitrophenyl-5-mercaptotetrazole, 1-naphthyl-5-mercaptotetrazole, 2-mercaptothiazole, mercaptobenzthiazole, mercaptonaphthothiazole, mercaptooxadiazole, mercaptopiperidine, 2-mercaptothiadizolotriazine, mercaptotriazine, mercaptobenzene, 1-mercapto-2-benzoic acid, 1-mercapto-2-nitrobenzene, heptadecanoylaminobenzene and 1-mercapto-3-heptadecanoylaminobenzene.

9. A light-sensitive silver halide colour photographic material as claimed in Claim 1, wherein said development releasing inhibitor compound is selected from the group consisting of

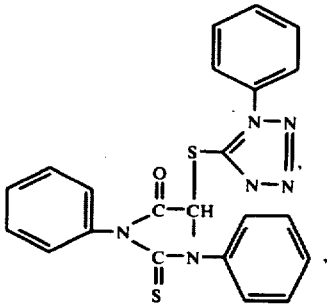

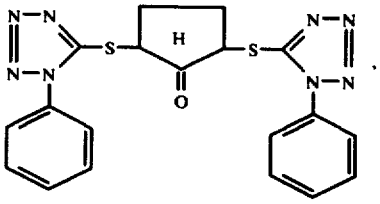

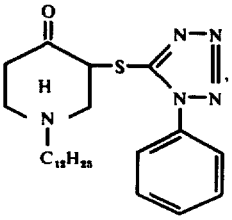

-continued
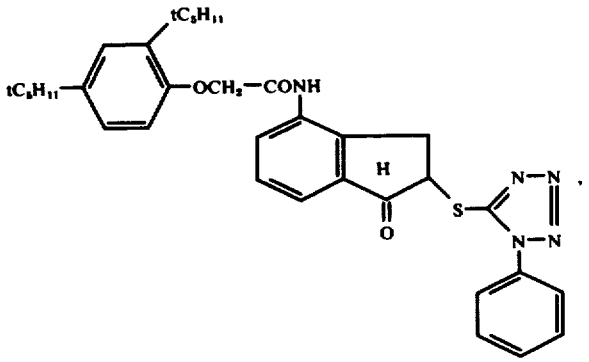
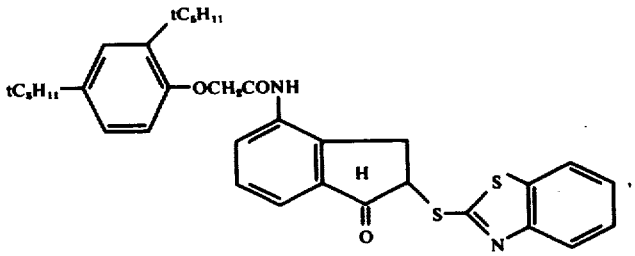
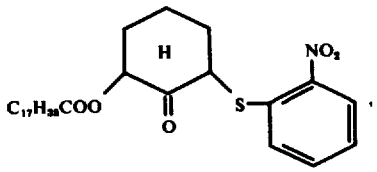
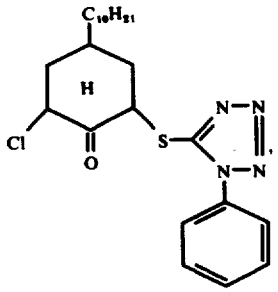
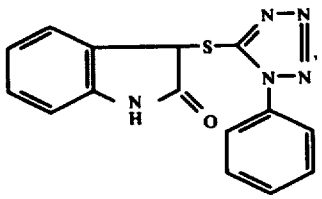
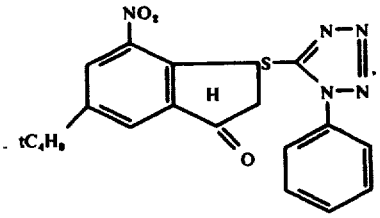

-continued
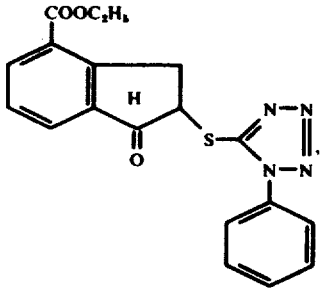
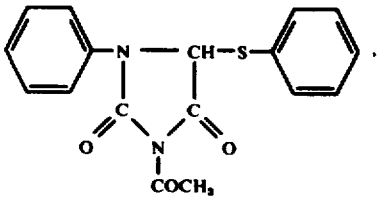
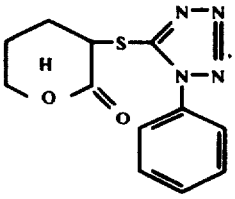
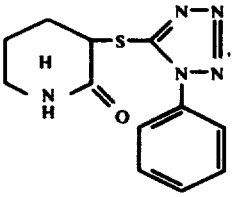
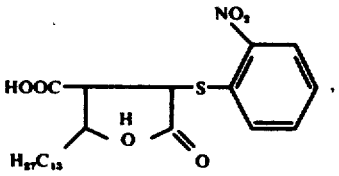
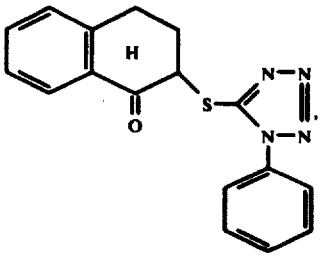
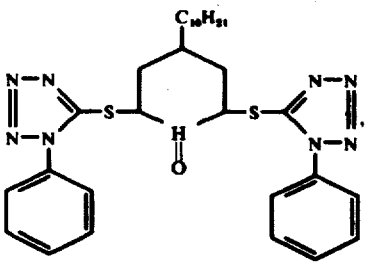

-continued
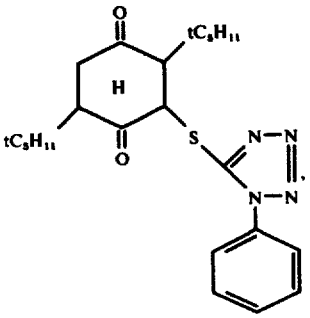
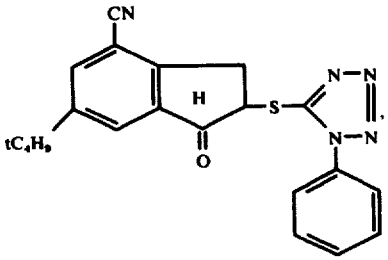
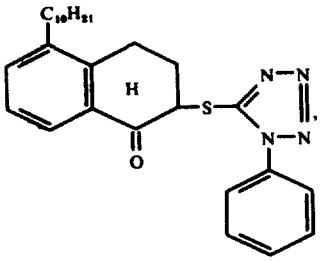
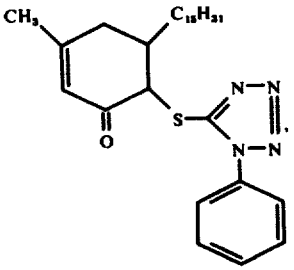
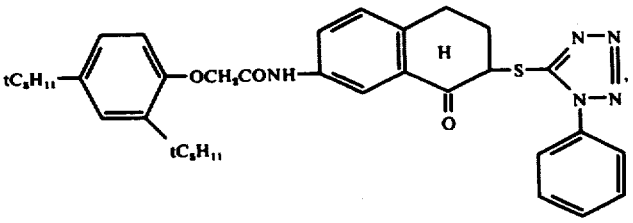
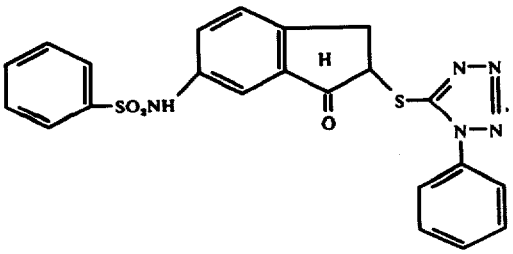

-continued
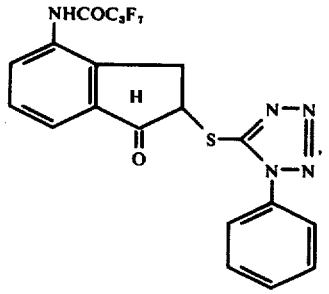
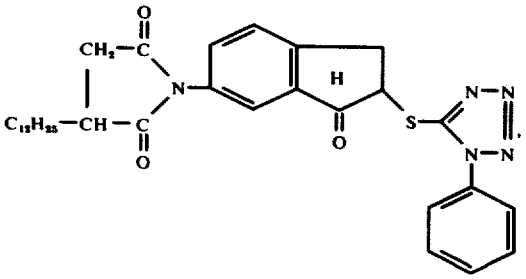
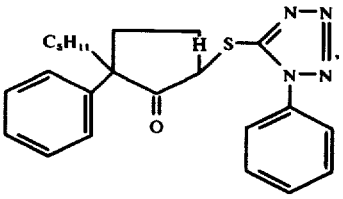
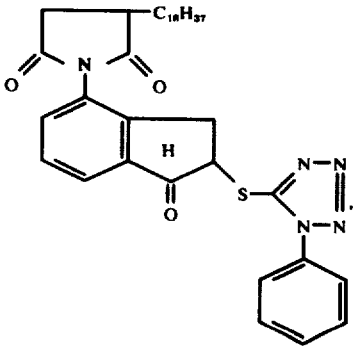
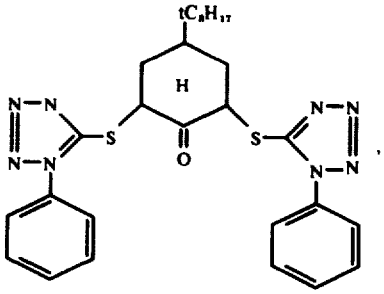
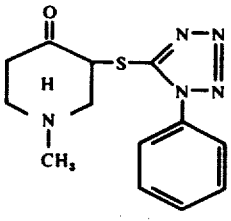
and -continued
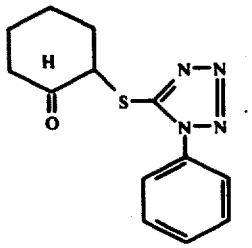
10. A process as claimed in claim 5, wherein said development releasing inhibitor compound is selected from the group consisting of
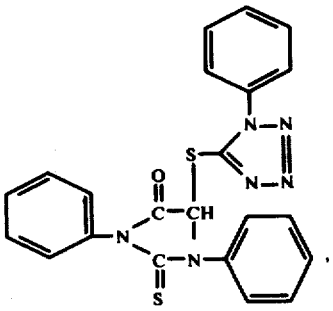
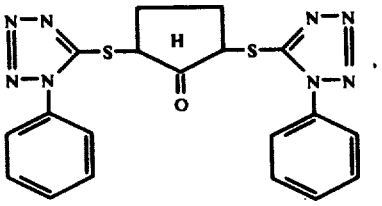
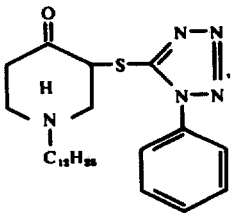
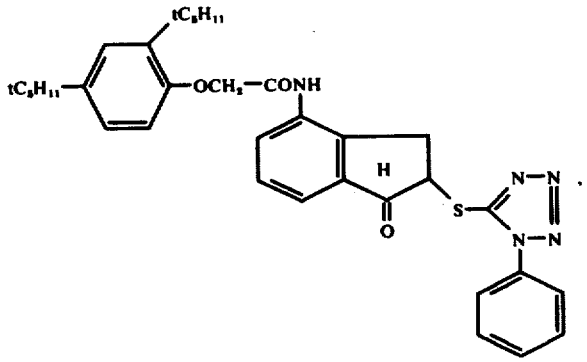

-continued
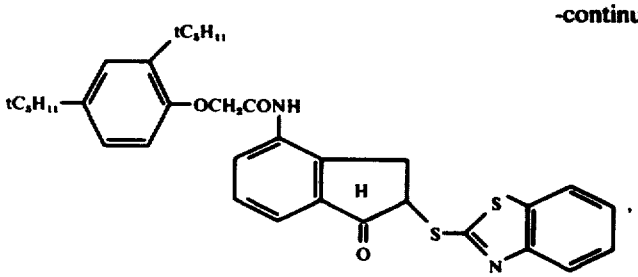
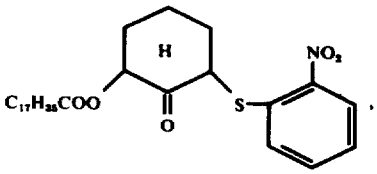
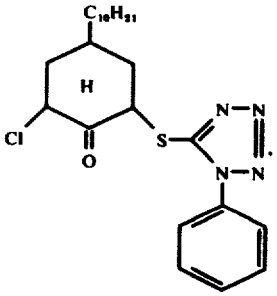
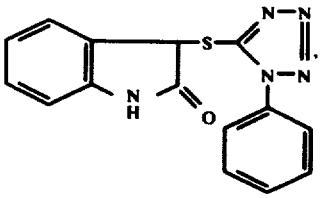
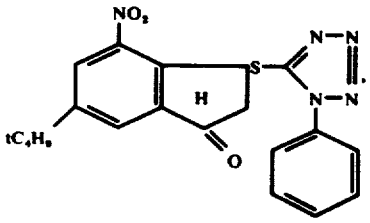
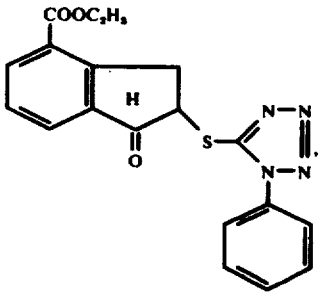
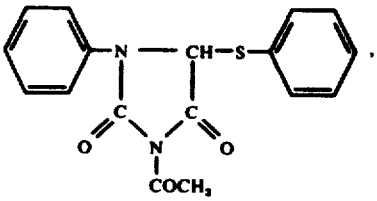

-continued
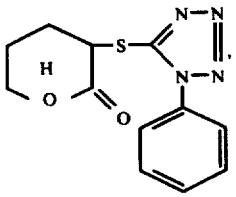
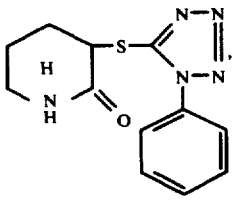
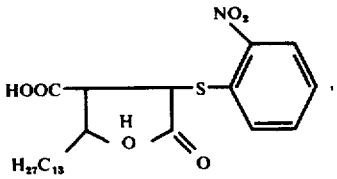
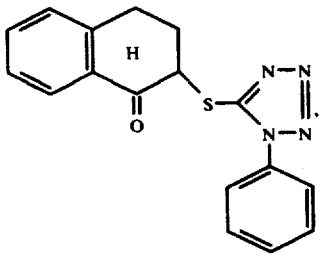
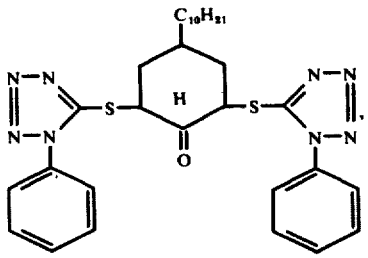
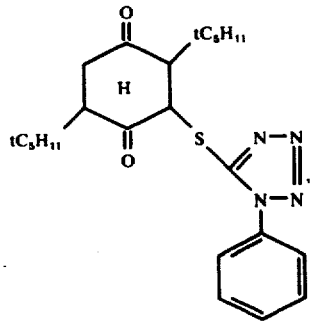

-continued
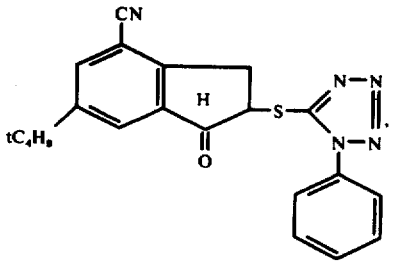
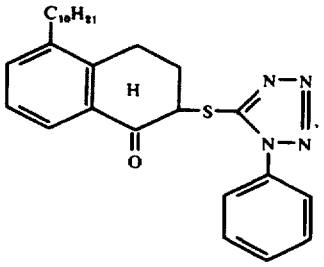
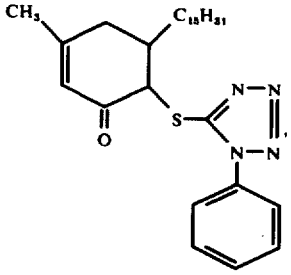
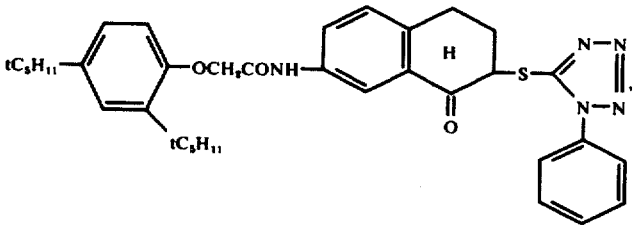
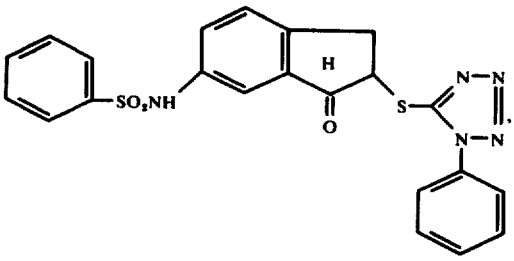
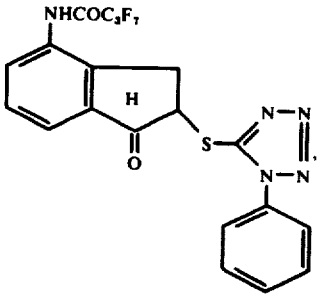

-continued
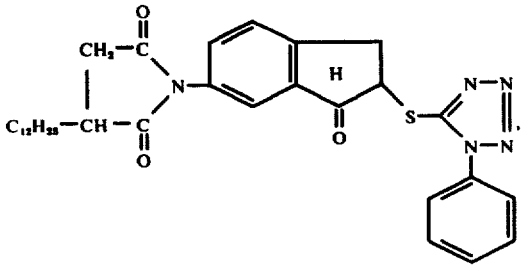
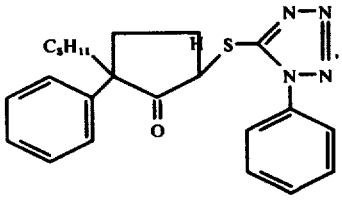
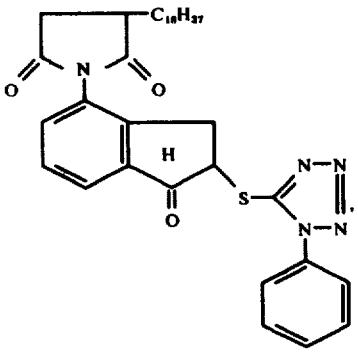
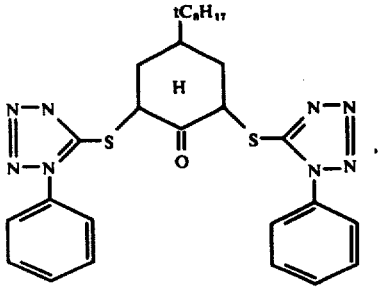
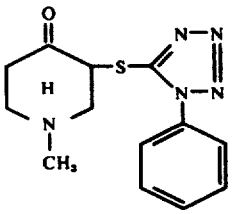
and
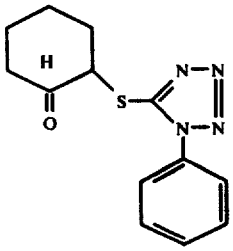
* * * * *